United States Patent [19]

Buta

[11] 4,454,738

[45] Jun. 19, 1984

[54] ROLLER LEVELER AND METHOD OF OPERATING SAME

[75] Inventor: John R. Buta, Salem, Ohio

[73] Assignee: The Paxson Machine Company, Salem, Ohio

[21] Appl. No.: 278,981

[22] Filed: Jun. 29, 1981

[51] Int. Cl.[3] ..... B21D 1/02

[52] U.S. Cl. ..... 72/21; 72/35; 72/163; 72/164

[58] Field of Search ..... 72/163–165, 72/160, 21, 35

[56] References Cited

U.S. PATENT DOCUMENTS

| | | | |
|---|---|---|---|
| 2,219,163 | 10/1940 | Maussnest | 72/35 |
| 2,429,142 | 10/1947 | Thomas | 72/163 |
| 2,491,782 | 12/1949 | Talbot | 72/163 |
| 2,949,147 | 8/1960 | Maust | 72/164 |
| 2,963,070 | 12/1960 | Maust | 72/163 |
| 3,078,908 | 2/1963 | Maust | 72/163 |
| 3,078,909 | 2/1963 | Maust | 72/165 |
| 3,395,559 | 8/1968 | Ungerer | 72/164 |
| 3,416,340 | 12/1968 | Reesor | 72/164 |
| 3,420,082 | 1/1969 | Bearer | 72/163 |
| 3,606,784 | 9/1971 | Schlüter | 72/165 |
| 3,650,137 | 3/1972 | Benz | 72/165 |
| 3,701,274 | 10/1972 | Roesch | 72/165 |
| 3,828,599 | 8/1974 | Withrow | 72/163 |
| 3,877,270 | 4/1975 | Marten | 72/21 |
| 4,074,555 | 2/1978 | Noe | 72/163 |

FOREIGN PATENT DOCUMENTS

| | | | |
|---|---|---|---|
| 2117489 | 10/1971 | Fed. Rep. of Germany | 72/164 |

*Primary Examiner*—Daniel C. Crane

*Attorney, Agent, or Firm*—Pearne, Gordon, Sessions, McCoy, Granger & Tilberry

[57] ABSTRACT

A roller leveler is provided with mechanisms to continuously sense and to measure roller deflection and to automatically correct the deflection based on the degree of deflection sensed. The sensing mechanisms are mounted on a structure which is isolated from the forces of deflection acting on the rollers and may comprise mechanical, electromechanical, electronic, sonar, optic, fiber optic, fluid, or laser devices. Novel back-up rolls are also provided to correct the deflection.

55 Claims, 26 Drawing Figures

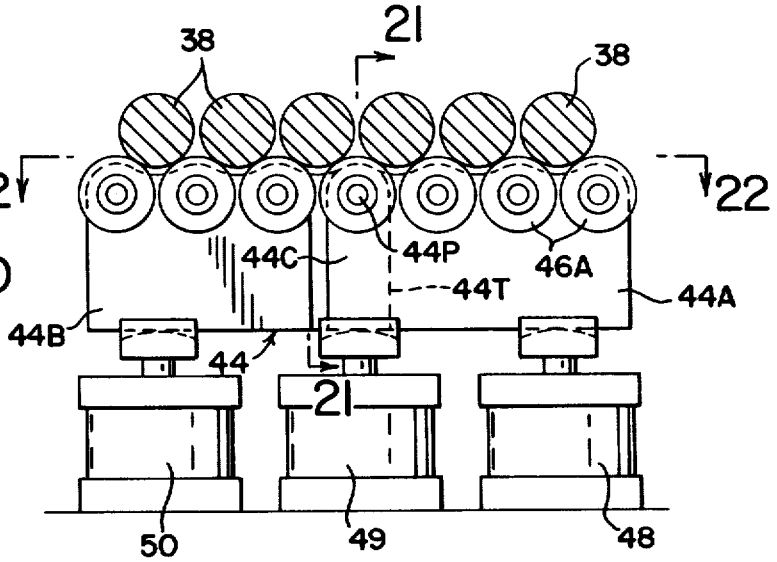
FIG. 20
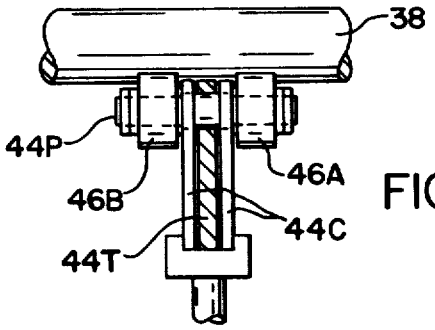
FIG. 21
FIG. 22
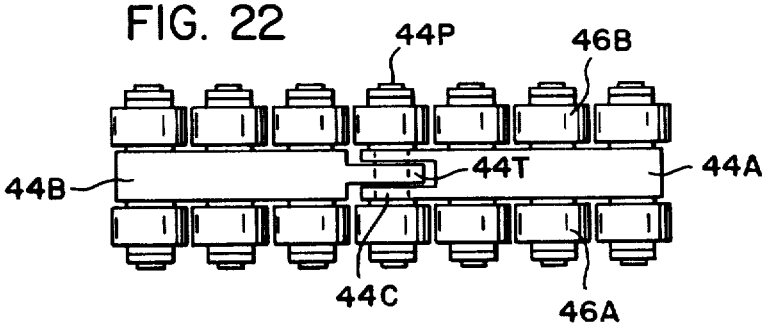

ROLLER LEVELER AND METHOD OF OPERATING SAME

BACKGROUND OF THE INVENTION

This invention relates to means for flattening coiled metal strip, sheets and plates. Machines which perform this function are variously referred to as flatteners, levelers, straighteners, or roller levelers. All of these machines perform essentially the same function and operate substantially upon the same general principles. For the purposes of this application, the invention will be referred to as a roller leveler.

Although a roller leveler is equally suitable for processing sheets and plates, for illustrative purposes, the function of a roller leveler will be herein described in relation to coiled strip. Metal is formed into strip by a process known as rolling, wherein the strip is passed between a pair of work rolls of a rolling mill to reduce its cross-sectional thickness. In the process, the strip is elongated and rolling continues until the strip is reduced to the cross-sectional thickness desired. This rolling process may start with heated billets or slabs of metal, wherein the metal is rolled at a very high temperature, or it may start with previously rolled strip wherein the strip is passed between work rolls in the cold state. In either event, when the strip exits from the mill it may be convolutely wrapped to form a so-called coil. When the coil has been formed, curvature of the coil tends to stay with the strip when it is necessary to uncoil the strip for further processing. Thus, the primary problem with strip coming off of a coil is the curvature which remains with the strip and which varies throughout the entire length of the coil as a function of the radius of any particular portion of the strip while in the coil. Accordingly, the outer wrap of the coil will have less curvature than an inner wrap. To remove this variable curvature in the strip is one of the purposes of a roller leveler. It is necessary to remove this curvature so that the strip may be cut accurately and rendered suitable for other manufacturing operations, such as punching, drawing, forming and the like. It is well established that the flatter the strip is prior to a subsequent manufacturing operation, the more accurate and satisfactory will be the end product of that operation. Thus, even where portions of steel strip are deep drawn, they do not draw as satisfactorily if the strip initially is not substantially flat before the draw.

The theory of operation of a roller leveler is quite simple in principle. It is to take an unknown problem and convert it into a known problem for which there is a known solution. By way of example, when the strip is taken from the coil it is not known what the particular degree of set is in any particular portion of the coil. Accordingly, the strip is passed through a combination of rollers which flex the strip a predetermined amount first in a given direction and then a predetermined amount in the opposite direction. Reverse flexing the strip in this manner by lesser and lesser amounts will eventually remove all curvature from it, irrespective of the degree of curvature set in the strip prior to entering the roller leveler.

In addition to strip curvature, other unwanted properties are sometimes impressed upon the strip during hot and/or cold rolling which render the problem of flattening strip much more complex. In order to reduce cross-sectional thickness of the strip during rolling, it is necessary to force the strip between rolls under tremendous pressure whereby the strip essentially becomes a wedge which tends to separate the rolls. The force of roll separation is dependent upon the physical properties of the strip including width, thickness, hardness, temperature, yield strengh, and amount of reduction being attempted during the pass of the strip between the rolls. If the work rolls are not sufficiently supported by so-called back-up rolls it is possible for the strip to actually cause the work rolls to bend at their centers, wherein the resultant strip cross-sectional shape is thicker in the middle than at the edges. Strip rolled with thicker center portions indicates that greater pressure has been applied to the edges of the strip than at the center, thereby causing the edges to elongate at a greater rate than the center of the strip. Because this excess metal on the edges must go somewhere, but is restrained by the center, the result usually is a product having what is referred to as edge waves. In other words, the center of the strip is relatively flat longitudinally but the edges of the strip are sinusoidal. Strip rolled with edge waves is usually not saleable.

Just the opposite may occur during rolling of strip, wherein the rolls may be so reinforced, or may be so contoured, that they resist or otherwise offset the wedge effect of the strip. However, if the rolls are over compensated against roll bending, the resultant is strip that is rolled thinner in the center than at the edges. In this circumstance, the center of the strip tends to become elongated, producing a condition sometimes referred to as "oil canning". By this is meant that the elongated center portion of the strip compensates for this elongation by bulging either up or down. The result is strip that can literally be snapped up and down like the bottom of an oil can because of the stresses set up by this localized elongation.

Essentially, therefore, a strip coming to a roller leveler from a rolling mill could conceivably have several basic defects. The strip could have a curvature set because it was formed into a coil, the strip could have edge waves because its center was rolled thicker than its edges, the strip could have oil canning because its center was rolled thinner than its edges, or the strip could have combinations of these defects.

It was discovered long before the subject invention that roller levelers, in addition to taking curvature out of coiled strip, could also remove the edge waves and/or the oil canning condition of the strip by skillful manipulation of the work rollers. On the other hand, if the strip came from the rolling mill fairly flat, an improperly operated roller leveler could create edge waving and/or oil canning in the strip. Thus, it was possible for the strip to exit the roller leveler in worse condition than it entered.

In order to avoid reducing the strip to poorer condition than when it was received, and at the same time correct what defects had been rolled into the strip from the mill, it has heretofore been necessary for an operator to continuously monitor and to adjust the work rollers of a roller leveler during the entire pass of the coil through the roller leveler. Obtaining a high quality of strip flatness from a prior art roller leveler is an art which can only be learned by an operator after many years of experience. Thus, it has been known in the prior art to bend the work rollers of a roller leveler to correct edge wave, oil canning and curvature. This is done by manipulating the work rollers of roller levelers. In the simplest form, a roller leveler comprises an upper work roller and two lower work rollers. However, in a practical industrial roller leveler the number of rollers are a matter of choice depending on the particular type of work being performed, and roller levelers having as many as twenty-nine rollers are known. It is also known that the more aggravated the condition of the non-flatness of the strip, the more rollers are required to bring the strip back to a flat condition. Particularly is this so in correcting edge waving and oil canning.

By way of general organization, a prior art roller leveler may include opposed upper and lower banks of work rollers and their associated back-up rolls. The upper bank of work rollers extends from side to side of the frame of the roller leveler and are positioned in parallel one behind the other from front to rear of the frame. The lower bank of work rollers also extends from side to side and from front to rear of the roller leveler frame and are parallel to the upper work rollers. However, the lower work rollers are offset so that an upper work roller may be brought substantially into tangential or nesting contact with a pair of lower work rollers. The spacing between the upper work roller and a pair of lower work rollers permits passage of the strip over a lower work roller, under the adjacent upper work roller and then over the next lower work roller. This spacing is referred to in the trade alternatively as the gap or plunge of the rollers. The more an upper work roller is plunged between a pair of lower work rollers, the greater is the so-called plunge which has been applied to the rollers. Conversely, the greater the plunge, the smaller is the resultant gap. This adjustment of rollers has been accomplished in the prior art with hydraulic jacks, mechanical screw jacks, wedges and the like.

In prior art roller levelers, each bank of work rollers can be shifted vertically up or down as a unit to increase or lessen the plunge between the upper and lower work rollers. Customarily, the upper and lower banks of rollers can also be tilted as a unit to provide decreasing plunge between the upper and lower work rollers from front to back. Thus, the flex of the strip at the entrance to the roller leveler may be relatively severe but this flexing will become less and less pronounced as the strip progresses between the work rollers from entrance to exit of the roller leveler.

To prevent the work rollers from bending due to the separating force of the strip while being flexed sinusoidally between upper and lower work rollers, relatively short back-up rolls are evenly spaced across the span of each work roller to prevent unwanted bending of an individual work roller. Each work roller may have as many as five or more small back-up rolls in tangential contact therewith. Corresponding back-up rolls from work roller to work roller may be in alignment from front to rear of the roller leveler and this alignment is referred to as a flight of back-up rolls. Thus, if each work roller has five supporting back-up rolls extending from side to side of the work roller, there would be five flights of back-up rolls extending from front to rear of the roller leveler.

In the prior art, each flight of back-up rolls is usually mounted on a massive beam, also extending from front to rear of the roller leveler frame. It is known for the beams to be moveable up or down but not to be tiltable. Only the entire bank of either upper or lower rolls are tiltable. Thus, by manipulating the back-up roll beams, which can be done by mechanical screw jacks, hydraulic cylinders, wedges and many other mechanical devices, the relative position of flights of back-up rolls may be adjusted within limits with respect to the work rollers. An experienced operator observing strip edge waving, oil canning or both, can, by manipulating the back-up roll beams up or down, bend the work rollers to remove the edge wave or the oil canning. However, it is important to emphasize that all of these adjustments in prior art roller levelers are manual and, as already stated, require great skill of the operator.

It is not unusual in roller levelers for the strip work product to exert a total separation force against the work rolls of approximately two million pounds. Thus, in the case of a roller leveler having five sets of back-up rolls per work roller, the separation force would be two hundred tons per flight of back-up rolls. To perform a good job of flattening the strip, the operator might be required to set the desired gap between rollers within 0.001 to 0.002 inches. However, the separating force of the strip between the rollers could cause, even under normal operation, a roller deflection of 0.030 to 0.120 inches. Furthermore, in addition to causing roller bending, the separating forces of the strip also cause the frame itself to bend and to stretch. Essentially, the inadequacy of the prior art roller levelers resides, therefore, in the fact that with the sides of the frame stretching, the crown of the frame bending, the base of the frame bending, and the rollers bending, there is no point of reference on the frame from which to maintain a predetermined gap between the rollers. With a prior art roller leveler, it would be ineffective to place a sensor on the crown of the frame to detect work roll deflection since it is conceivable that at the same time that the work roll is deflecting 0.030 inches the crown of the roller leveler is also deflecting 0.030 inches, whereby the sensor would read no deflection whatsoever. In like manner, if the sensor were mounted on the side of the roller leveler frame, wedging apart of the rollers by the strip could not be accurately measured because of the stretch in the sides of the frame.

The foregoing is a brief summary of the state of the prior art. No automation, heretofore, has been accomplished with roller levelers because the roller leveler is in a state of dynamic change during a leveling operation at which time virtually all parts of the roller leveler are being subjected to stresses and strains of indeterminate magnitude and duration, uncontrolled and continuously varying. The only means available to the prior art to cope with the above uncontrolled variables in roller leveler mechanisms is to make manual adjustments, solely at the discretion of the operator. The end product, therefore, is a direct function of the skill of the operator to cope with all of the variables of the roller leveler under stress and strain. Successful automation of the operation of a roller leveler prior to the subject invention has, within the applicant's knowledge, never been accomplished.

DESCRIPTION OF THE INVENTION

The principle objective of the subject invention is to provide means to pre-set and to automatically hold work rollers to a predetermined gap, irrespective of the varying forces acting on the roller leveler and the distortions in the work rollers and frame caused by these forces. To accomplish this objective it is the applicant's inventive concept to utilize sensors to detect roller deflection at any position along the span of the roll where correction is required to be made, such positioning of the sensors being entirely independent of the stretching and the deflection of the roller leveler frame and rollers. By isolating the sensors from the roller frame dynamics of distortion, it can be determined where the rollers are at all times in relation to where they should be. Once this relationship is established, appropriate means can then be brought into play to maintain the rollers at predetermined positions. Thus, since the position of the sensors is known, it is possible to automate responses to sensor detected roller distortion which initiate corrective forces to return the rollers to their predetermined positions.

To accomplish the foregoing, the applicant conceived, in its preferred practical embodiment, a generally rectangular, sensor mounting structure with the upper corners of the structure secured to the opposite side members of the roller leveler frame. Except for these two contact points, the sensor structure is not otherwise supported or in contact with the roller leveler frame. The sensor structure comprises an upper horizontal cross piece spaced above the upper back-up rolls, and a lower cross piece spaced below the lower back-up rolls. As many sensors are mounted on each of these cross pieces as there are flights of back-up rolls, and the sensors are positioned as close as possible to the back-up roll mounting beams. Whether the sensors are adapted to sense movement of the back-up rolls, the back-up roll mounting beams, the crown of the roller leveler frame, or the work rollers, is relatively immaterial since these deflections will all be substantially the same when acted upon by a workpiece passing through the roller leveler.

The controlled gap can be maintained in several different ways. In a first embodiment of the invention a horizontal gap is maintained between the work rollers during the leveling operation. In a second embodiment, the work rollers are permitted to bend but the bending is matched between the upper and lower work rolls so that the gap between corresponding portions of upper and lower work rollers is always maintained a substantially predetermined constant. Thus, in the second embodiment, the upper and lower rollers may bend but their curvatures will be arcs of concentric circles whereby the gap between rollers will not change. The second embodiment achieves a slightly less perfect flattening of the strip but is acceptable for most commercial applications. For the ultimate in flatness, the first embodiment is employed wherein the upper and lower work rollers are maintained exactly where they are preset in order to maintain horizontal predetermined gaps across the spans of the upper and lower rollers. Both embodiments produce a quality of flatness superior to any prior art roller levelers known to applicant.

In order to achieve this superior result, the first and second embodiments of the invention contemplate having each backup roll mounting beam adjustable at both the front and back portions, wherein the beam can be shifted vertically or tilted either toward the front or the rear of the roller leveler. With each mounting beam separately adjustable both vertically and tiltably, many more adjustment combinations can be made during the leveling process than possible by prior art roller levelers.

In a third embodiment of the invention, the back-up roll mounting beams are articulated. In a preferred embodiment they are articulated at their mid-sections so as to provide combinations of roll adjustments along flights of back-up rolls. It is also contemplated that the beams may be articulated in two or more places.

In a fourth embodiment the back-up roll beams may be dispensed with and there is provided, in lieu thereof, a separate back-up roll adjustment device, such as a hydraulic cylinder, for each back-up roll, or set of back-up rolls, in a flight of back-up rolls. Thereby, every contact point on every work roll will be separately adjustable. Furthermore, each of these adjustments can be calibrated and programmed to be maintained at any position desired. In this fourth embodiment of the invention, the combinations of adjustments of back-up rolls and work rollers to cope with deformation of work strip are virtually limitless.

OBJECTS OF THE INVENTION

It is therefore among the objects of the invention to provide a roller leveler having improvements over prior art devices including: means to establish and to automatically maintain a desired plunge between upper and lower work rollers; means for full automation of the roller leveler; means to provide a fixed point of reference for making work roller adjustments; sensor means for continuously monitoring the shapes of the work rollers; non-deformable sensor mounting means; control means responsive to sensor signals to automatically adjust work roller shapes; means for accurately and automatically making roller shape adjustments responsive to sensor signals; electronic control means responsive to sensor signals to actuate hydraulic means to make work roller shape adjustments; means to adjust flights of back-up rolls both vertically and arcuately; articulated back-up roll support beams; individually adjustable back-up rolls; means to maintain predetermined roller gap or to change roller gap by automatically adjusting the back-up rolls of one bank of work rolls only; means to automatically maintain predetermined roller gap or to change roller gap by automatically adjusting the back-up rolls of both banks of work rollers; means to automatically maintain predetermined gaps between matching upper and lower work rollers; means to automatically maintain predetermined horizontal gaps between matching upper and lower work rollers; means to automatically maintain zero deflection of upper and lower work rollers; means to adjust the shapes of one bank of work rollers to compensate for deflection of matching rollers in the other bank of work rollers; a novel unitary roller leveler frame; novel roll adjustment floating zero reference means; and means to operate roller levelers by methods not heretofore known or possible.

It is also among the objects of the invention to provide a roller leveler which will: process plates, strips and coils of metal of such imperfect shape that they could not be processed on prior art roller levelers; process cheaper grades of plates, strips and coils; process plates, strips and coils at higher production rates; be operable at lower labor costs; process plates, strips and coils to provide a better quality of flatness; process plates, strips and coils to more consistently provide a better quality of flatness; process plates, strips and coils with less rejected material; require less operator attention; and which will enable methods of operation heretofore not possible.

Other objects, improved features and advantages of the invention will become apparent to those skilled in the art from a study of the detailed descriptions of the preferred embodiments set forth herein and illustrated in the accompanying drawings.

BRIEF DESCRIPTION OF THE DRAWINGS

FIG. 20 is a schematic side elevational representation of an articulated back-up roll support beam used in a preferred embodiment of the invention;

FIG. 21 is a schematic sectional view taken along the line 21—21 of FIG. 20;

FIG. 22 is a schematic plan view taken along the line 22—22 of FIG. 21;

DETAILED DESCRIPTION OF THE INVENTION

Figure 1:
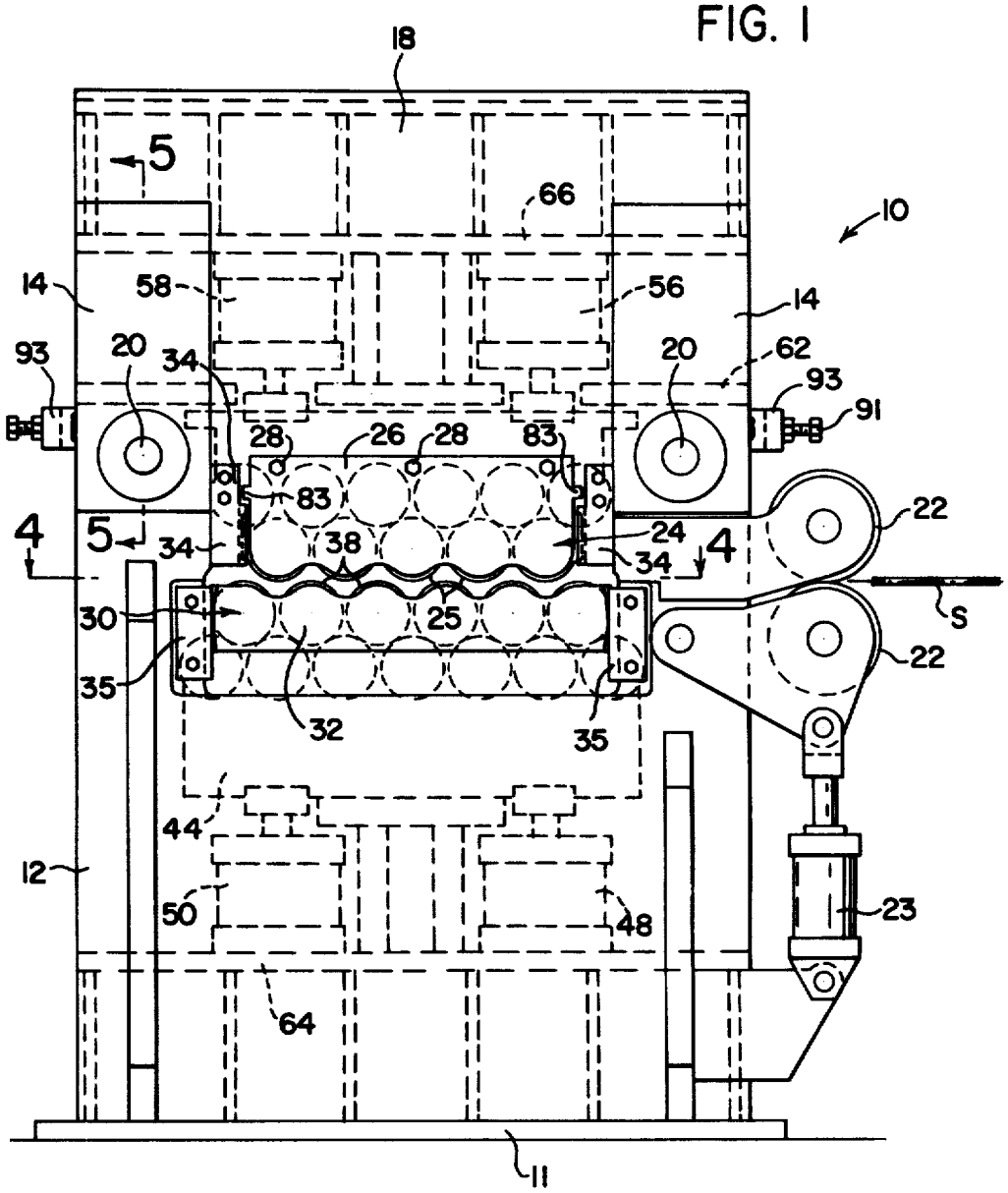
FIG. 1 is a side elevational view of a preferred embodiment of the invention.
Figure 2:
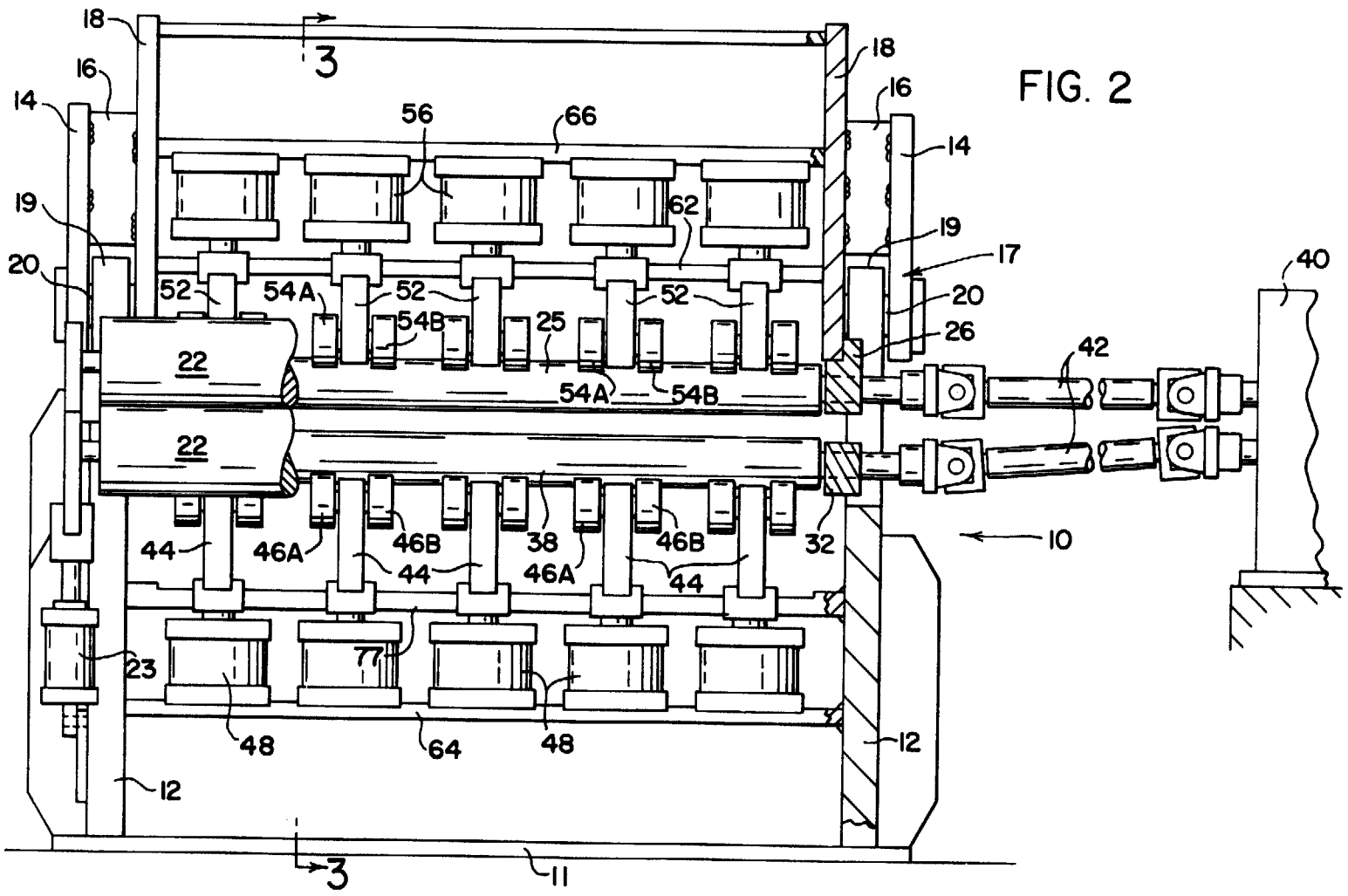
FIG. 2 is a front elevational view of the preferred embodiment of the invention shown in FIG. 1.

Referring now to the Figures in greater detail, and in particular to FIGS. 1 and 2, therein is shown a roller leveler 10 comprising a weldment frame having steel side slabs 12, welded to base slab 11 to form the lower half of the frame 10. As best shown in FIG. 2, the upper half of frame 10 comprises slabs 14 welded to spacing members 16 which in turn are welded to slabs 18. Slabs 14 and 18 are thus spaced apart sufficiently to form clevises 17 which fit over the upper ends 19 of slabs 12 and are connected thereto by means of pins 20.

Referring specifically to FIG. 1, therein is shown a pair of pinch rolls 22 mounted at the entrance to the roller leveler 10 to receive strip S and to positively guide the strip into the roller leveler. The pinch rolls are adjusted by hydraulic cylinder means 23. An upper bank 24 of five separately driven work rollers 25 is supported at opposite ends of the rollers in journal beams 26. In one embodiment of the invention, journal beams 26 may be immoveably bolted to the upper portion of the frame such as with fastener means 28. In another embodiment of the invention, journal beams 26 are mounted in gibs 34 so that they may be shifted vertically and/or arcuately, as will be described more fully hereinafter. A lower bank 30 of six separately driven rollers 38 is shown with opposite ends journaled in journal beams 32. Journal beams 32 are also fitted in gibs 35 to permit vertical and/or arcuate movement. It will be observed that rollers 25 of upper bank 24 are spaced to nest between pairs of lower rollers 38 in lower bank 30.

Figure 3:
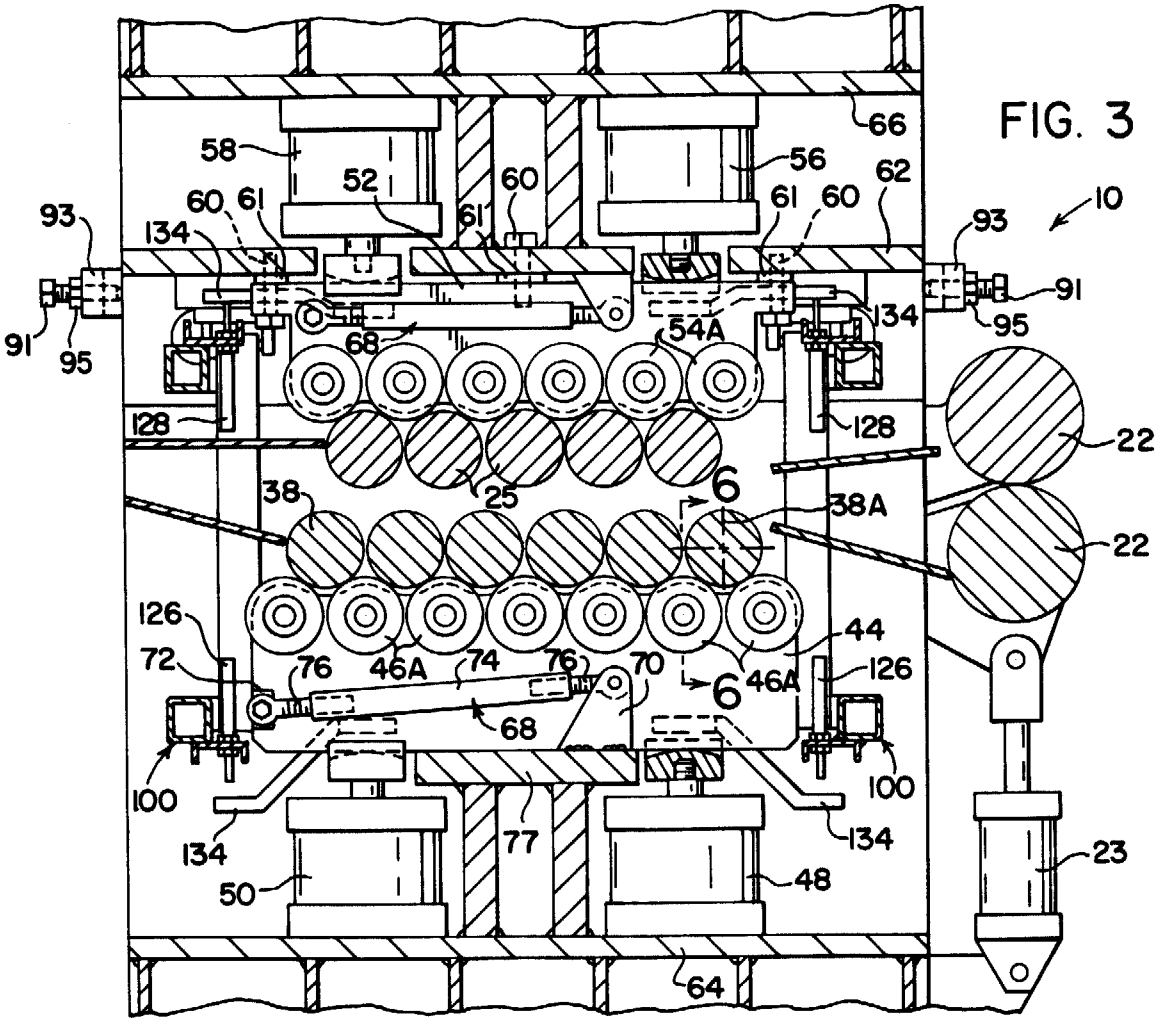
FIG. 3 is an enlarged fragmentary side elevational view, partially in section, of the preferred embodiment of the invention as shown in FIGS. 1 and 2, taken along the line 3—3 of FIG. 2.

Referring specifically to FIG. 2, it will be seen that a pinion stand 40 is provided whereby each of the upper rollers 25 and lower rollers 38 are individually driven by pinion stand drive shafts 42. There are five lower back-up roll mounting beams 44 evenly spaced along the span of the lower rollers 38, each mounting beam carrying a flight of back-up rolls 46A and 46B from front to rear of the roller leveler. As shown in FIG. 3, there are seven pairs of back-up rolls 46A–46B mounted on each back-up roll mounting beam 44. It will be observed that the back-up rolls are spaced so that each flight provides four back-up rolls in tangential contact with each lower work roller. Thus, by inspecting FIGS. 2 and 3, it will be seen that a first pair of back-up rolls 46A–46B is in tangential contact with an adjacent work roller 38 forward of the vertical centerline 38A of the work roller and a second pair of back-up rolls 46A–46B is in tangential contact with this work roller rearward of the vertical centerline for a total flight of fourteen back-up rolls per mounting beam. Except for the outboard back-up rolls, forward and rearward of each flight, the intermediate back-up rolls are each in shared tangential supporting contact with a pair of work rollers 38.

An hydraulic cylinder 48 is mounted under the front end of each back-up roll mounting beam 44, and a second hydraulic cylinder 50 is mounted under a rearward end of each back-up roll mounting beam. As more fully explained hereinafter, actuation of hydraulic cylinders 48 and 50 will cause back-up roll mounting beam 44 to shift vertically and/or arcuately to bring back-up rolls 46A and 46B into tangential pressure contact with adjacent work rollers 38.

Figure 6:
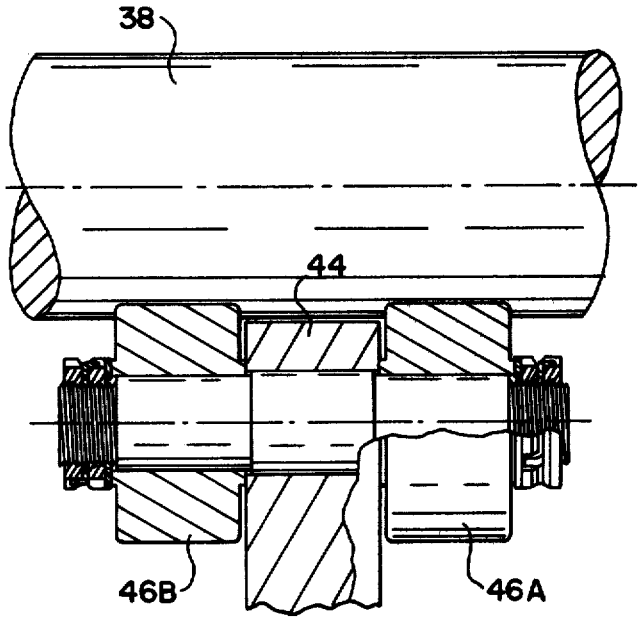
FIG. 6 is an enlarged fragmentary elevational view in section taken along the line 6—6 of FIG. 3.

Similarly, as shown in FIG. 2, there are also five flights of upper back-up roll mounting beams 52 evenly spaced along the span of upper work rollers 25. Each mounting beam 52 carries a flight of back-up rolls 54A–54B arrayed front and rear of rollers 25 for tangential contact therewith. The flights of back-up rolls 54A–54B are aligned from front to rear of the roller leveler. As shown in FIG. 3, a flight of six pairs of upper back-up rolls 54A–54B are mounted on each back-up roll mounting beam 52. The upper back-up rolls are also positioned so that each flight provides four back-up rolls in tangential contact with each upper work roller in the same manner as described with respect to lower back-up rolls 46A–46B. See also FIG. 6.

An hydraulic cylinder 56 is mounted above the front end of each upper back-up roll mounting beam 52, and a second hydraulic cylinder 58 is mounted above the rearward end of each upper back-up roll mounting beam. In the same manner as the lower hydraulic cylinders 48 and 50, actuation of hydraulic cylinders 56 and 58 will cause upper back-up roll beams 52 to shift vertically and/or arcuately to bring the upper back-up rolls 54A–54B into tangenetial pressure contact with adjacent work rollers 25.

As best shown in FIG. 3, in one preferred embodiment of the invention, upper back-up roll mounting beams 52 may be immobilized by threaded fasteners 60 positioned at opposite ends and intermediate of each upper back-up roll mounting beam 52 to lock each beam into threaded engagement with upper slab member 62. Limited adjustment of the bank of upper back-up rolls 25 may be obtained by placing an appropriate number of spacers, washers or shims 61 between the beam 52 and upper slab member 62. It should be noted that whereas lower cylinders 48 and 50 rest on reinforced slab member 64, hydraulic cylinders 56 and 58 are suspended from the underside of reinforced slab member 66.

Figure 4:
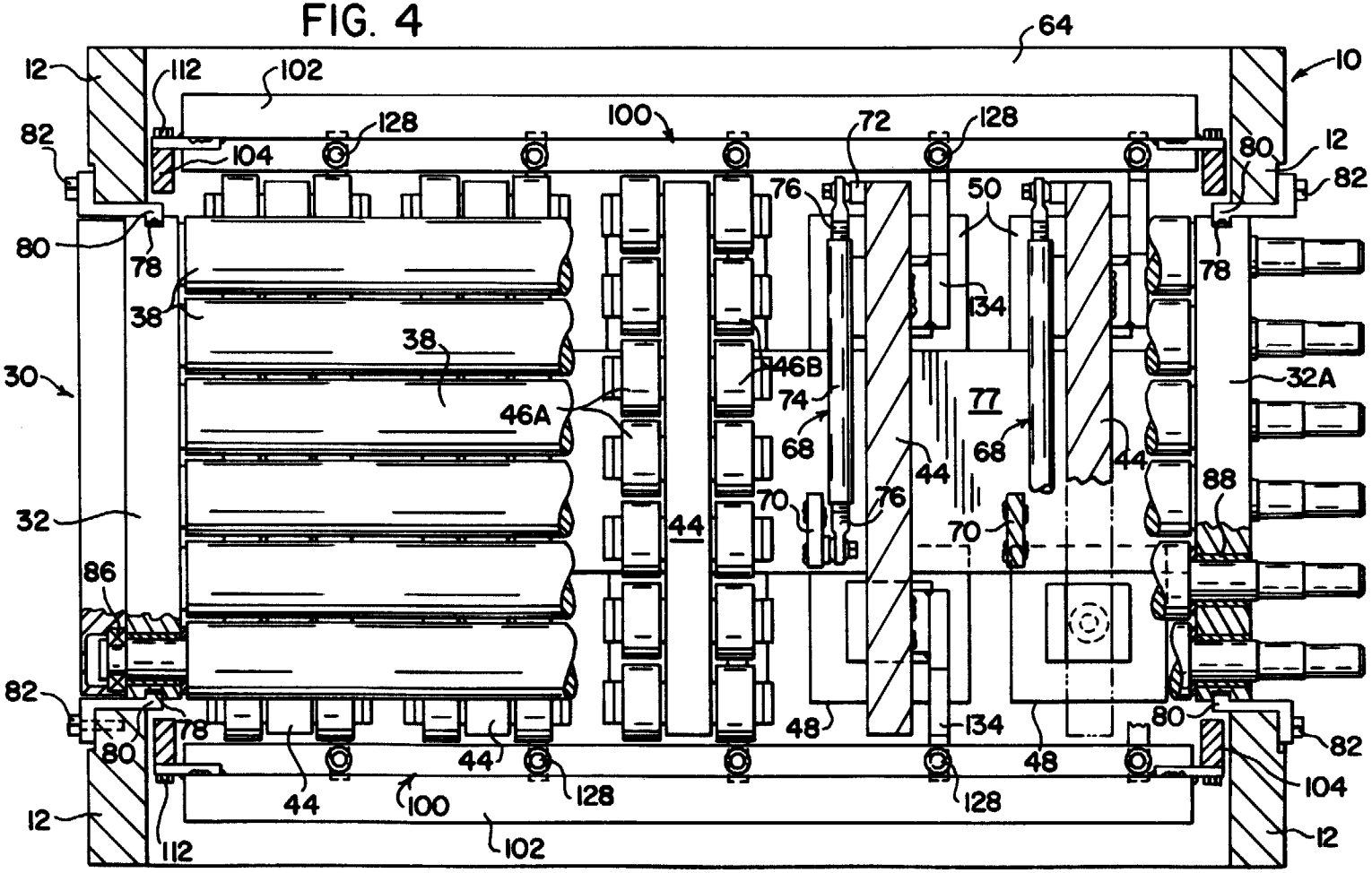
FIG. 4 is an enlarged plan view, partially in section, of the preferred embodiment of the invention taken along the line 4—4 of FIG. 1.

Each lower back-up roll mounting beam 44 is stabilized against longitudinal shifting by a stabilizer rod 68, see FIGS. 3 and 4. One end of each rod is secured to frame trunnion 70 and the other end is secured to the back-up roll supporting beam 72. The stabilizing rod comprises an internally threaded center member 74 and external threaded members 76 which threadedly engage the opposite ends of the center member 74 to provide for the connections with trunnion 70 and beam portion 72. The upper back-up roll beams 52 are similarly stabilized against longitudinal shifting by stabilizing rods 68. The lower back-up roll beams 44 are supported on slab 77 only when the roller leveler is inoperative.

FIG. 4 also illustrates the mounting of the ends of lower work rollers 38 in journal beams 32–32A. Keyways 78 are engaged by keys 80 to permit vertical and/or arcuate shifting of the jcurnal beams 32–32A. Keys 80 are threadedly secured by fasteners 82 to slab portions 12 of the frame 10. Similar keys and keyways are provided with respect to the bank 24 of upper work rollers to permit vertical and/or arcuate shifting of this upper bank, including gib stop means 83, FIG. 1, to prevent the journal beams 26 from escaping downwardly from their gibs 34. Side thrust of work rollers is not considered a significant problem in the subject invention. Nevertheless, as shown in FIG. 4, thrust bearings 86 are provided on the left ends of the upper and lower work rollers which adequately compensate for any unexpected lateral thrust which might develop during the operation of the leveler. On the opposite side of the rollers, it will be observed that plane bearings 88 are utilized to mount the roller ends in journal beam 32A.

Figure 5:
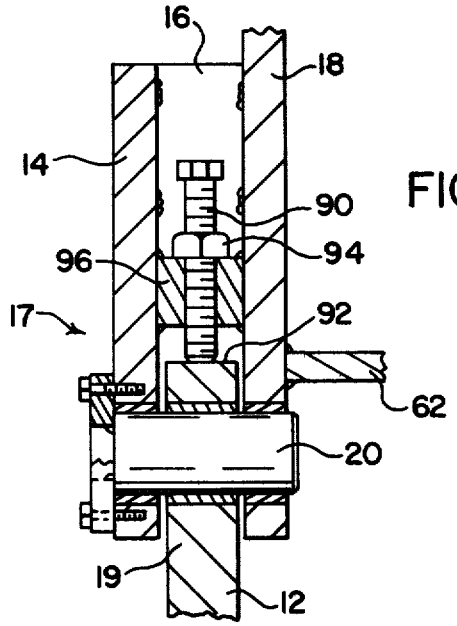
FIG. 5 is an enlarged fragmentary elevational view in section taken along the line 5—5 of FIG. 1.

As shown in FIG. 5, the clevis 17, comprised of slabs 14, 16, 18, is connected to lower slab 12 by means of pin 20. Clevis 17 is rigidly locked to lower slab 12 by means of set screws 90 and 91. Set screw 90 is brought into pressure contact with the upper surface 92 of slab 12 and held in place by lock nut 94. To this end, set screw 90 is threadedly received in cross member 96 against which lock nut 94 is brought into pressure contact. Set screw 91, FIG. 3, is threadedly mounted on saddle 93 which bridges upper slabs 14 and 18 so as to enable set screw 91 to be brought into pressure bearing contact with the upper end 19 of lower slab 12, and locked in place by lock nut 95.

Figure 7:
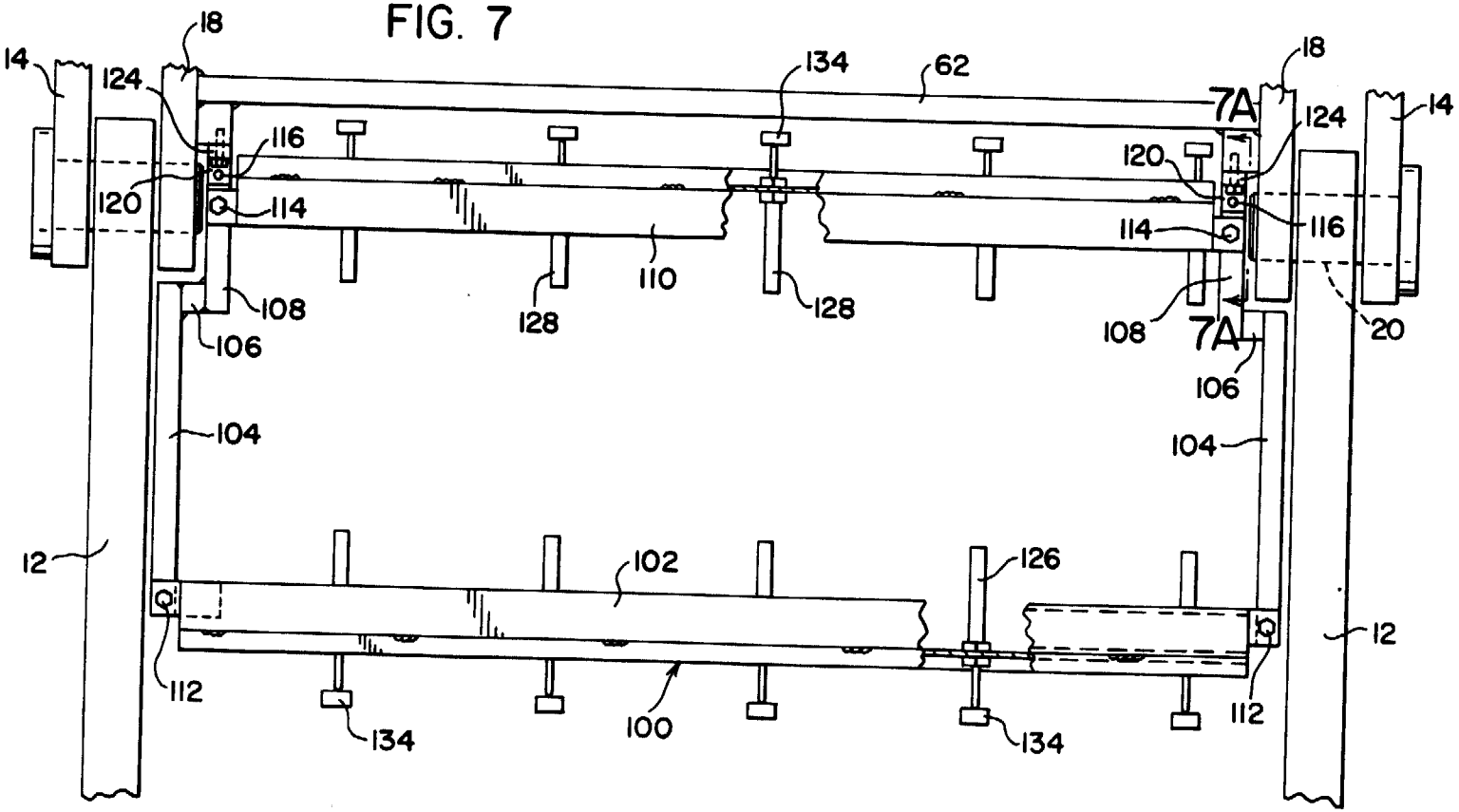
FIG. 7 is an elevational view of the non-deformable sensor mounting structure used in the preferred embodiments of the invention.
Figure 7A:
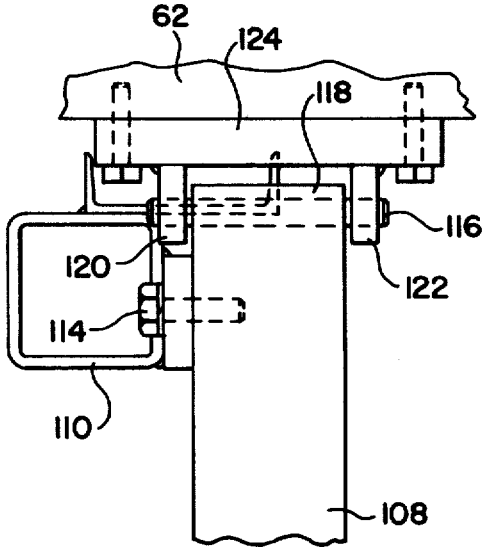
FIG. 7A is a fragmentary elevational view of the sensor mounting structure taken along the line 7A—7A of FIG. 7.

Referring now to FIG. 7, therein is shown a nondeformable sensor mounting structure 100 which is comprised of light weight tubular cross-sectional members including lower cross piece 102, vertical support pieces 104, horizontal offset portions 106, vertical support pieces 108 and top horizontal cross piece 110. The lower cross piece member 102 is secured to the vertical support members 104 by threaded fasteners 112. Upper horizontal cross piece 110 is secured to vertical portions 108 by threaded fasteners 114. Referring to FIG. 7A, the entire sensor frame 100 is suspended within the roller leveler frame 10 by pins 116 which support the upper ends 118 of vertical members 108 within clevis members 120 and 122 secured to frame cross plate 124.

The lower cross piece 102 has mounted thereon five evenly spaced apart sensors 126, each of which are further positioned to detect movement of a corresponding mounting beam, hydraulic cylinder, frame portion or the like, to directly or indirectly detect deflection or bending of a work roller. For instance assuming sensor bracket 100 to be mounted at the entrance of the leveler 10, then each sensor 126 may be positioned adjacent a corresponding back-up roll support beam 44 and adapted to detect movement of the beam. In this embodiment, the upper cross piece 110 also carries five sensors 128 to detect movement of corresponding upper back-up roll support beams 52. The sensors in the embodiment shown in FIG. 7 are electromechanical transducers which transform mechanical movement into electrical signals. No claim is made to the transducer per se, there being many commercially available transducers suitable for use in the invention. In the preferred embodiment of the invention, an electromechanical transducer was selected. Specifically, the Trans-Tek Incorporated Gaging Transducer DC-DC Series 350 was adopted. For the lower crosspiece sensors 126, Trans-Tek Model No. 354-000 was used. For the upper crosspiece sensors 128, Trans-Tek Model No. 352-000 was used. An example of a suitable commercially available sonic sensor is the Milltronics Microranger transducer. A suitable optic-fiber optic sensor is the Banner LED photoelectric scanner. A laser sensor suitable for use in the invention manufactured by M.E.A. Inc. is the NeHe measurement type laser operating on 5 milliwatts or less. Examples of fluid power positioning devices are described in the June 1981 issue of Control Engineering.

Operation of the Roller Leveler

As briefly discussed heretofore, one of the primary functions of a roller leveler is to remove curvature from a piece of metal strip, sheet or plate. Strip is defined to mean metal which is sufficiently narrow and is rolled sufficiently thin that it can be wrapped into a coil. A sheet is defined as metal that is, for whatever reason, cut into lengths rather than stored in coiled form. Plate is metal which is too thick, as a practical matter, to be formed into a coil.

Figure 8:
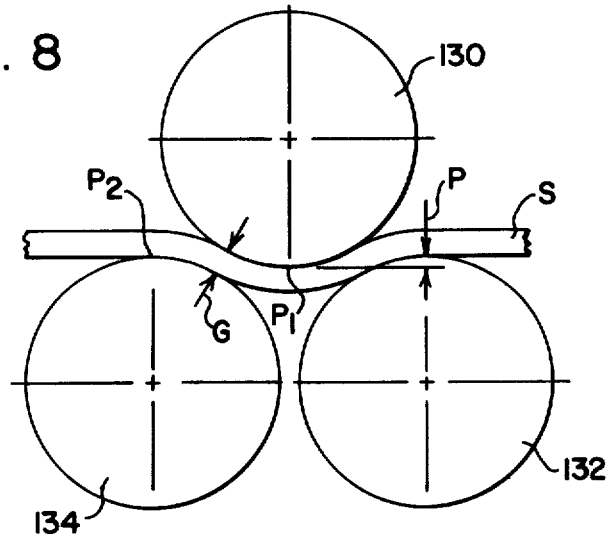
FIG. 8 is a schematic representation of a roller leveler having three rollers.

In the case of sheets and plates, the curvature would normally be of a substantially constant radius and the roller leveler means could be of the simplest form to flatten the sheet or plate. For this operation, the roller leveler would theoretically require only a combination of three work rollers, such as schematically shown in FIG. 8 in exaggerated relationship for purposes of illustration. The roller leveler would comprise an upper work roller 130 and a pair of lower work rollers 132 and 134. It will be observed that a sheet S moving from right to left is flexed downwardly between upper work roller 130 and lower work roller 132 and then is reverse flexed between upper work roller 130 and lower work roller 134 which removes the simple curvature from the sheet. To remove the curvature from the sheet S the upper work roller 130 and lower work rollers 132 and 134 must be properly positioned with respect to each other. This positioning will vary depending upon the amount of curvature which must be removed from the sheet. Thus, the upper and lower work rollers are vertically adjustable with respect to each other to increase or decrease the gap G between the rollers. As also already briefly discussed, the relationship between the upper and lower work rollers is sometimes referred to in terms of the "plunge". The plunge may be defined as the vertical measure between the lowermost point of the upper work roller and the uppermost point of the lower work rollers. Thus, if the vertical displacement between points P1 and P2 is one-quarter inch, it may be said that the plunge P of the work rollers is one-quarter inch.

Figure 9:
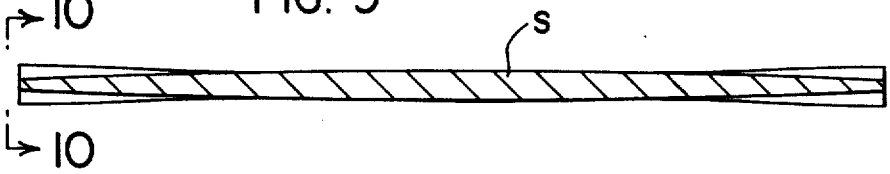
FIG. 9 is a schematic representation of the cross-section of a workpiece rolled thicker in the center than at the edges taken along the line 9—9 of FIG. 10.
Figure 10:
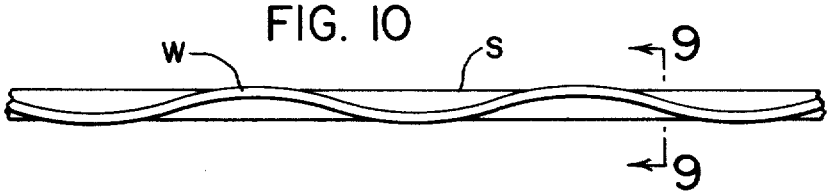
FIG. 10 is a schematic elevational representation of the edge waving of the workpiece taken along the line 10—10 of FIG. 9.

The other important use of roller levelers is to make corrections in the shape of strip as it comes from the rolling mill. It has been previously noted that, when strip is passed between the rolls of a rolling mill, tremendous pressures are exerted against the rolls tending to force them apart. When this occurs the strip tends to be rolled thinner at the edges than in the center portion, as shown in FIG. 9, which is also exaggerated for purposes of illustration. It is understood that the difference between the thickness of the edges of the strip and of the center of the strip may be only a few thousandths of an inch or less. When this condition obtains, the edges of the strip are narrower because more metal has been rolled in these areas than in the center portion, resulting in edges which are longer than the center portion of the strip. As a consequence, since the edges of the strip are restrained from elongating by the shorter thicker center portion of the strip, these edges respond to this restraint by forming into edge waves W as shown in FIG. 10. The edge waves W are defined as being the undulations caused when the edges of the strip are rolled thinner than the center portion.

Figure 11:
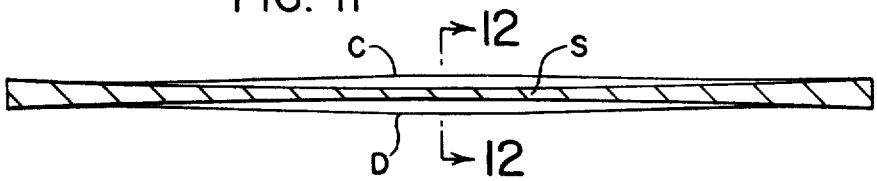
FIG. 11 is a schematic representation of the cross-section of a workpiece rolled thinner in the center than at the edges taken along the line 11—11 of FIG. 12.
Figure 12:
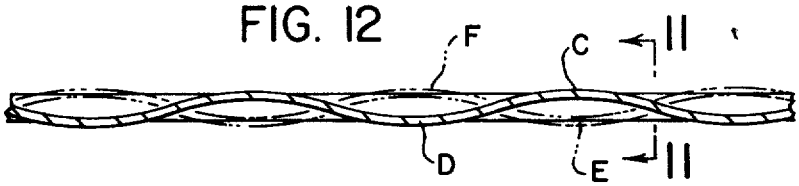
FIG. 12 is a schematic elevational representation of the oil canning of the workpiece taken along the line 12—12 of FIG. 11.

Strip may also be rolled with the center portion thinner than the edge portions, as shown in FIG. 11. In this example, the center of the strip is longer than the edges. In order to compensate for this disparity between edge length and center length, the center of the strip undulates as shown at C and D in FIG. 12. This is the condition refered to as oil canning, wherein the positions of C and D shown in solid lines may reverse to the corresponding positions E and F shown in phantom. In other words, the strip at positions C and D may snap back and forth or reverse their relative positions to E and F because of this elongation in the center of the strip. A third condition of the strip is one in which the strip at various places along its longitudinal axis will vary between edge waving and oil canning.

It has been found that by increasing the number of upper and lower work rollers to increase the number of upward and downward flexures of the strip, controlled stretching can be applied to the strip to correct both edge waving and oil canning. These corrections are obtained by control of the gap between work rollers. There is theoretically no limit to the number of upper and lower work rollers which may be utilized for this corrective action, and the lighter the strip the more work rolls are required. Although roller levelers are known with as many as twenty-nine work rollers, sheet or strip in excess of one-quarter inch can be satisfactorily processed with from nine to eleven work rollers.

Figure 13:
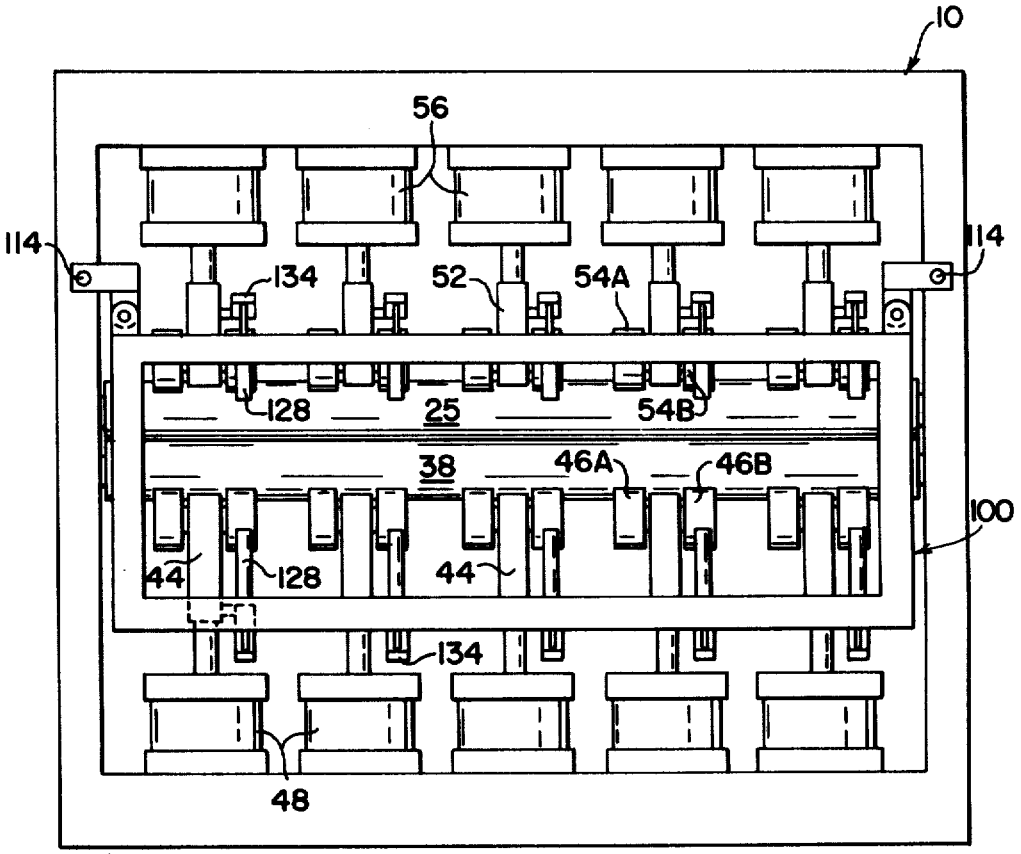
FIG. 13 is a schematic elevational view of the sensor mounting bracket secured to the side members of a roller leveler frame.
Figure 14:
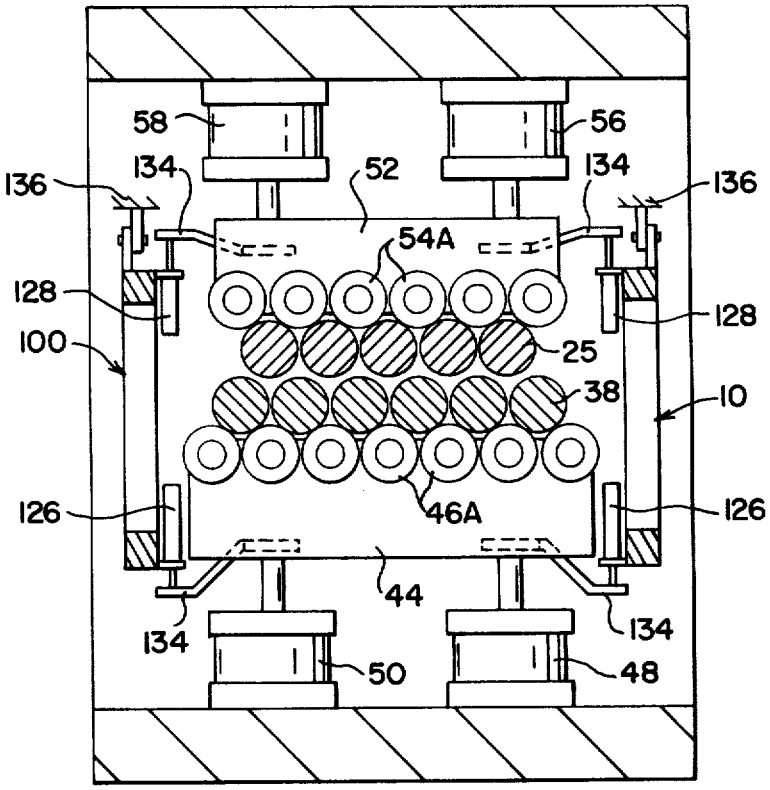
FIG. 14 is a schematic elevational side view of a roller leveler showing entrance and exit sensor mounting structures isolated from the forces of distortion to which the roller leveler frame is subject.

Referring to FIGS. 13 and 14, it will be seen that work rollers 25 and 38 are each supported by five flights of back-up rolls 54 and 46, respectively. Each flight of lower back-up rolls is supported by a back-up roll beam 44 and each flight of upper back-up rolls is supported by a back-up roll beam 52. Mounted to the front and rear of the roller leveler are non-deformable sensor mounting structures 100. Each lower back-up roll beam is provided with front and rear hydraulic adjustment cylinders 48 and 50 and each upper back-up roll beam is provided with front and rear hydraulic adjustment cylinders 56 and 58. There is a sensor mounted on each sensor mounting structure for each back-up roll beam. Thus, there are ten back-up roll beams, and ten sensors mounted at the entrance of the roller leveler, and there are also ten sensors mounted at the exit of the roller, so that each back-up roll mounting beam has both its forward and rearward portions monitored for movement by a corresponding sensor. It will be noted in FIG. 14 that sensor mounting structures 100 may be mounted on support means 136 isolated from the roller leveler frame, and are thereby totally free of the effects of frame distortion due to roller bending.

Figure 15:
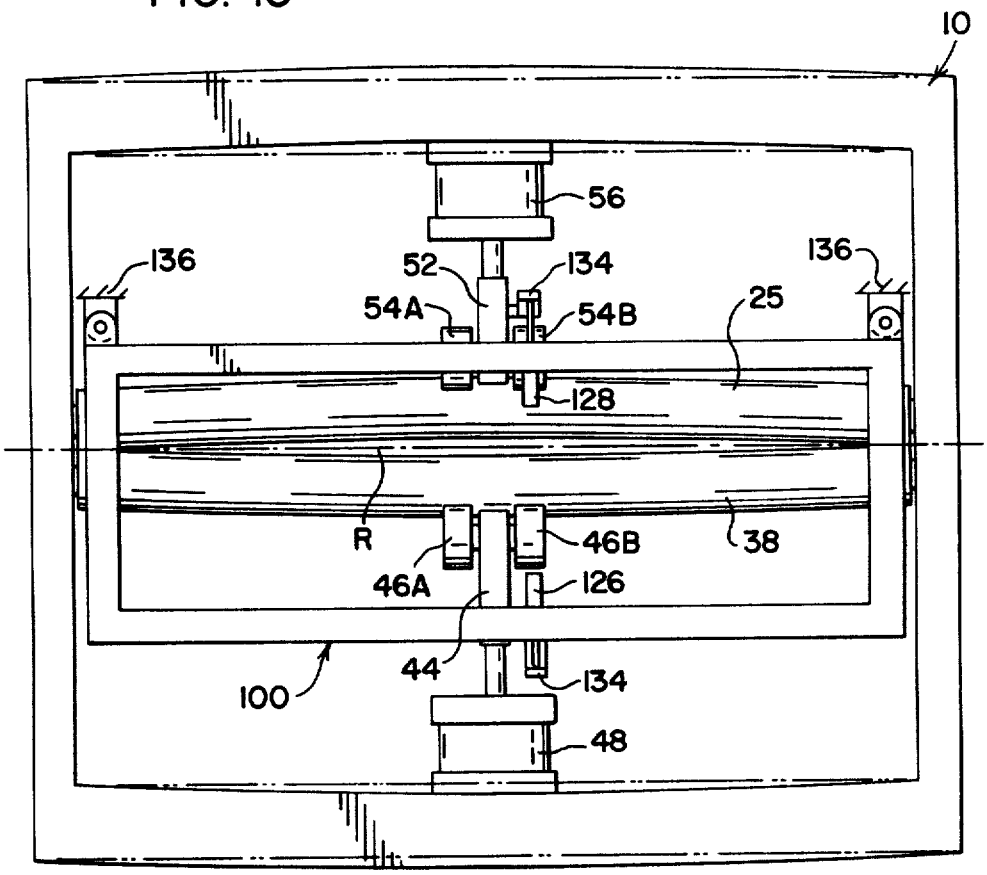
FIG. 15 is a schematic elevational front view of a roller leveler showing the results of the forces of separation acting upon the rollers.

Reference is now made to FIG. 15. Under conditions where the separating force of the strip causes the work rollers 25 and 38 to bend at their centers, in a first preferred embodiment of the invention, upper and lower sensors will detect this bending movement away from the reference plane R located by sensor mounting structure 100. In the case of the upper work roller, if the bend of the roller is upwardly, the difference between the actual position of the roller and reference plane R may be arbitrarily considered a positive deflection for purposes of illustration. This difference will be noted and a signal will be sent to the corresponding hydraulic cylinder 56 to urge the work roller 25 back to its intended position relative to the reference plane R. If, of course, the work rollers were deflected downwardly, then the difference between the position of the work roller 25 and the reference plane R would be negative or less than zero. In this case, the hydraulic cylinder 56 would be signaled to retract to relieve the pressure on the back-up rollers 54A and 54B thereby permitting the work roller 25 to return to its preset position using plane R as a reference. In this first embodiment of the invention, the bottom work roller 38 is also preset relative to reference plane R and any deviation from the reference will provoke a similar signal to the corresponding hydraulic cylinder 48 to make the necessary correction. With this system, both upper and lower work rollers are referenced to a fixed zero reference plane which is not affected by roller deflection. It is possible therefore to maintain the work rolls horizontal and with a preset uniform gap therebetween, or any variation in gap from side to side of the work rollers desired.

Figure 16:
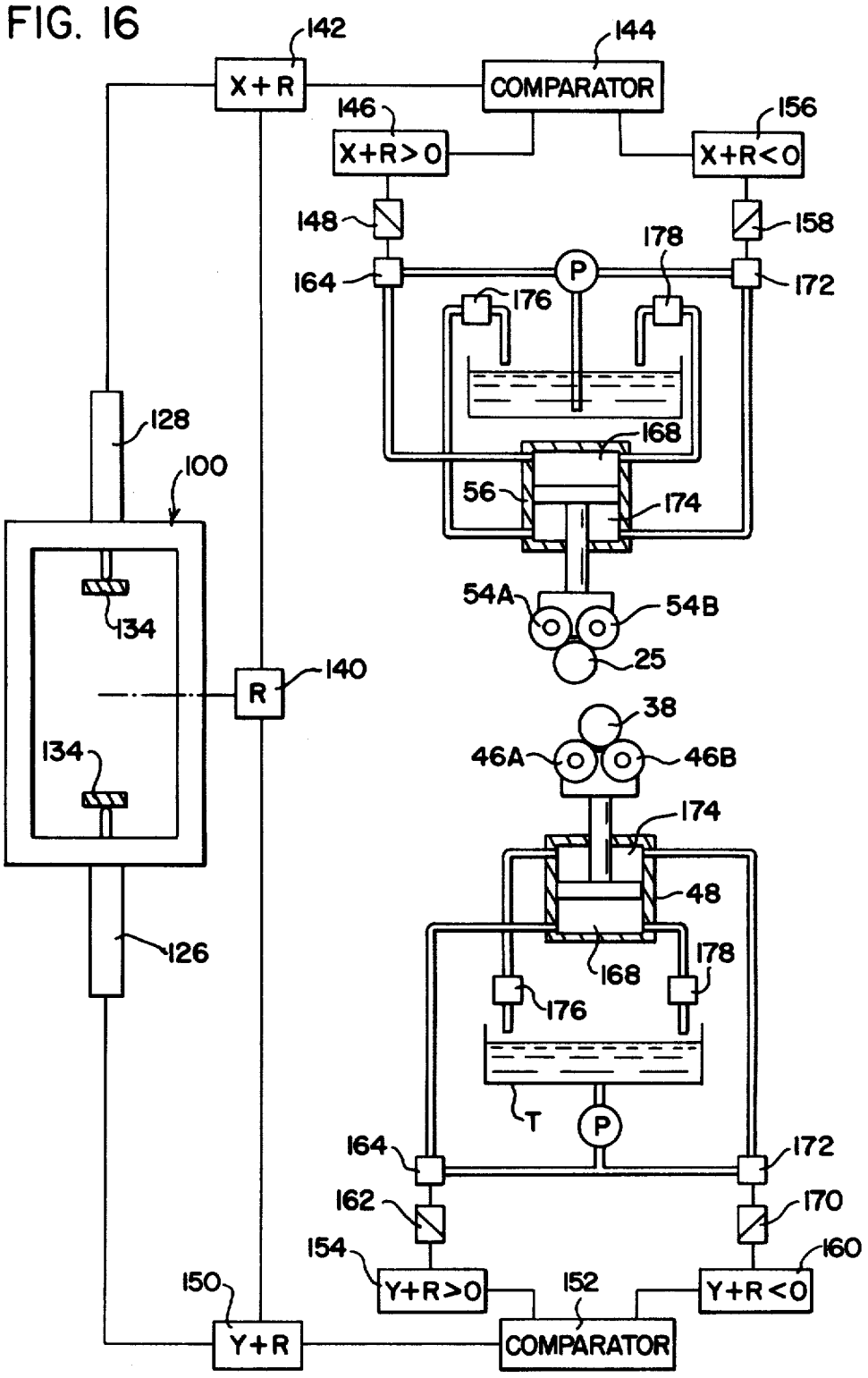
FIG. 16 is a schematic representation of one preferred embodiment of roller leveler control means.

Referring to FIG. 16, therein is schematically shown a sensor mounting structure 100 upon which are mounted upper and lower sensors which sense upper and lower work roller deflections. Considering first upper work roller deflection, a signal from upper sensor 128, detecting movement of an upper sensor detecting rod 134, and a constant signal from preset reference plane R indicator 140 are relayed to receiver 142 where the signals are amplified, conditioned, calibrated and the reference plane signal R is algebraically added to the work roller deflection signal X. The algebraic sum of these two signals provides a resultant signal which is forwarded to comparator 144. If the signal is positive, meaning that upper work roller 25 has been deflected upwardly, the signal is relayed to solenoid valve control 146 which directs the solenoid valve 148 to actuate hydraulic cylinder 56 to apply downward pressure to back-up rolls 54A and 54B until work roller 25 has been returned to the desired spacial relationship with reference to plane R.

In the event the algebraic sum of the upper work roller signal X and reference plane R signal is less than zero, comparator 144 relays the signal to solenoid control 156. Solenoid control 156 directs solenoid valve 158 to actuate hydraulic cylinder 56 to remove appropriate downward pressure from back-up rolls 54A and 54B. When work roller 25 has been returned to the desired spacial relationship with reference plane R, hydraulic cylinder 56 is deactivated.

Referring to lower work roller deflection, a signal from lower sensor 126, detecting movement of a lower sensor detecting rod 134, and from preset reference plane R indicator 140 are relayed to receiver 150 where the signals are amplified, conditioned, calibrated and the reference plane signal R is algebraically added to the work roller deflection signal Y. The algebraic sum of these two signals provides a resultant signal which is forwarded to comparator 152. If the signal is positive, indicating that lower work roller 38 has been deflected downwardly, the signal is relayed to solenoid valve control 154 which directs the solenoid valve 162 to actuate hydraulic cylinder 48 to apply upward pressure to back-up rolls 46A and 46B until work roller 38 has been returned to the desired spacial relationship with reference plane R.

In the event the algebraic sum of the signal Y and the reference plane R signal is less than zero, comparator 152 relays the signal to solenoid control 160. Solenoid control 160 directs solenoid valve 170 to actuate hydraulic cylinder 48 to remove appropriate upward pressure from back-up rolls 46A and 46B. When work roller 38 has been returned to the desired spacial relationship with reference plane R, hydraulic cylinder 48 is deactivated. The upward and downward movement of hydraulic cylinders 48 and 56 will be more or less continuous so long as upper and lower work rollers 25 and 38 vary from their predetermined desired positions in the roller leveler.

Figure 17:
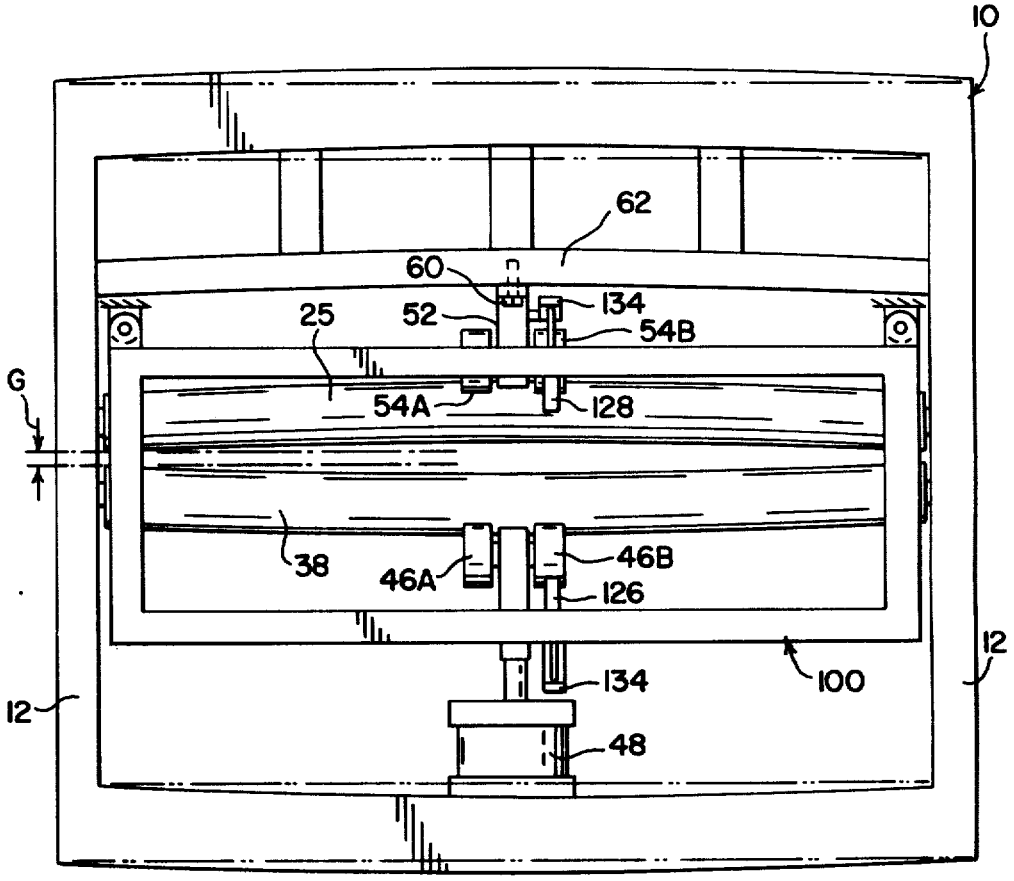
FIGS. 17 and 18 are schematic representations of one embodiment of gap maintenance between rollers that have been bent by the wedging action of the work product.
Figure 18:
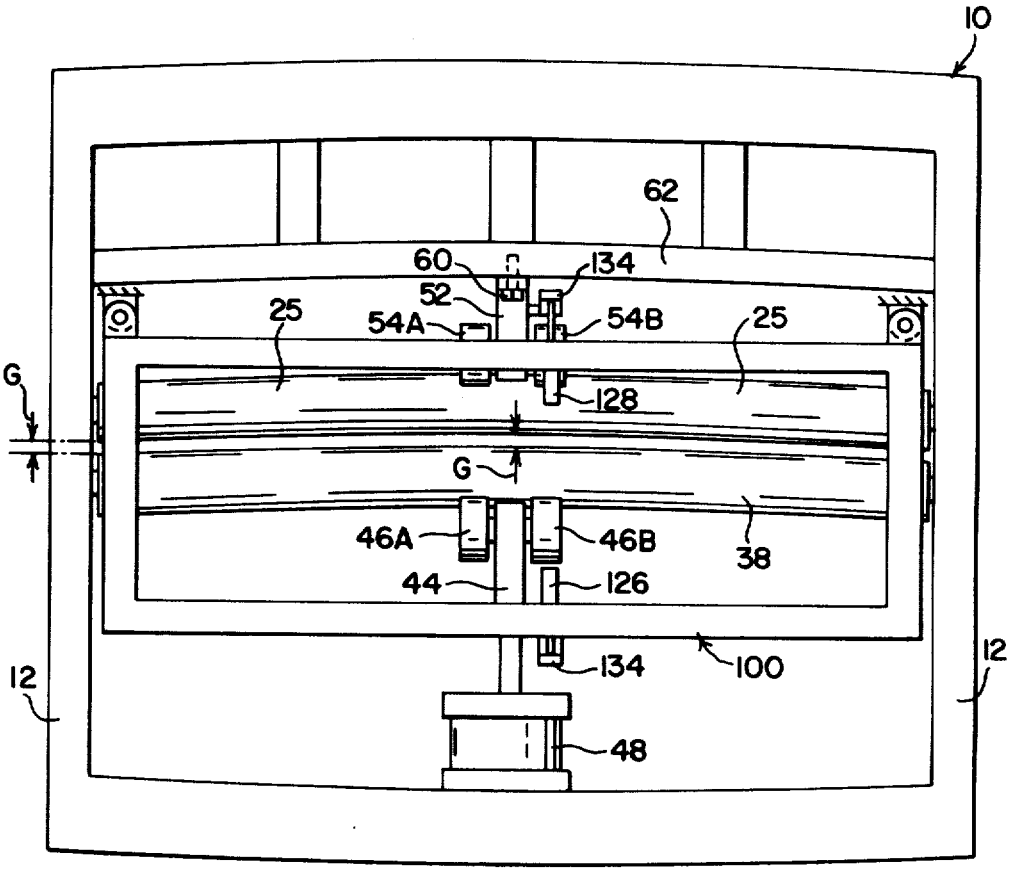

In a second embodiment of the invention, as shown in FIGS. 17 and 18, only the bottom back-up rolls 46A and 46B are hydraulically adjustable, wherein the upper back-up roll mounting beam 52 is rigidly secured to the slab 62 of the frame by threaded fasteners 60. A predetermined gap G is set between the upper and lower work rollers and, should any bending of the upper and/or lower work rollers occur, this bending is detected by upper and lower sensors and the deviations are algebraically added. The algebraic sum of the movement of the upper and lower work rollers is then compared to the preset gap G. If the consequent algebraic sum is greater than the preset gap, a signal is sent to the solenoid valve control 154 of hydraulic cylinder 48, actuating solenoid 162 to cause the hydraulic cylinder to bend the lower work roller 38 until the gap between the upper and lower work rollers equals the predetermined gap G.

If the algebraic sum of deflection of the upper and lower work rollers is less than the predetermined gap G, then the solenoid valve control 160 of hydraulic cylinder 48 and solenoid 170 are actuated to relieve the pressure against the underside of the bottom work roller 38 until the spacing between the upper and lower work rollers is once again equal to the predetermined gap. It will be understood that in actual practice the movement of the upper work roller could be plus or minus, and/or the movement of one of the work rolls could be zero. In any event, all of the adjustment is performed on the lower work roller to maintain the predetermined gap. As a result, the gap is maintained constant, but it is along an arcuate path following the bend of the upper roller 25.

Figure 19:
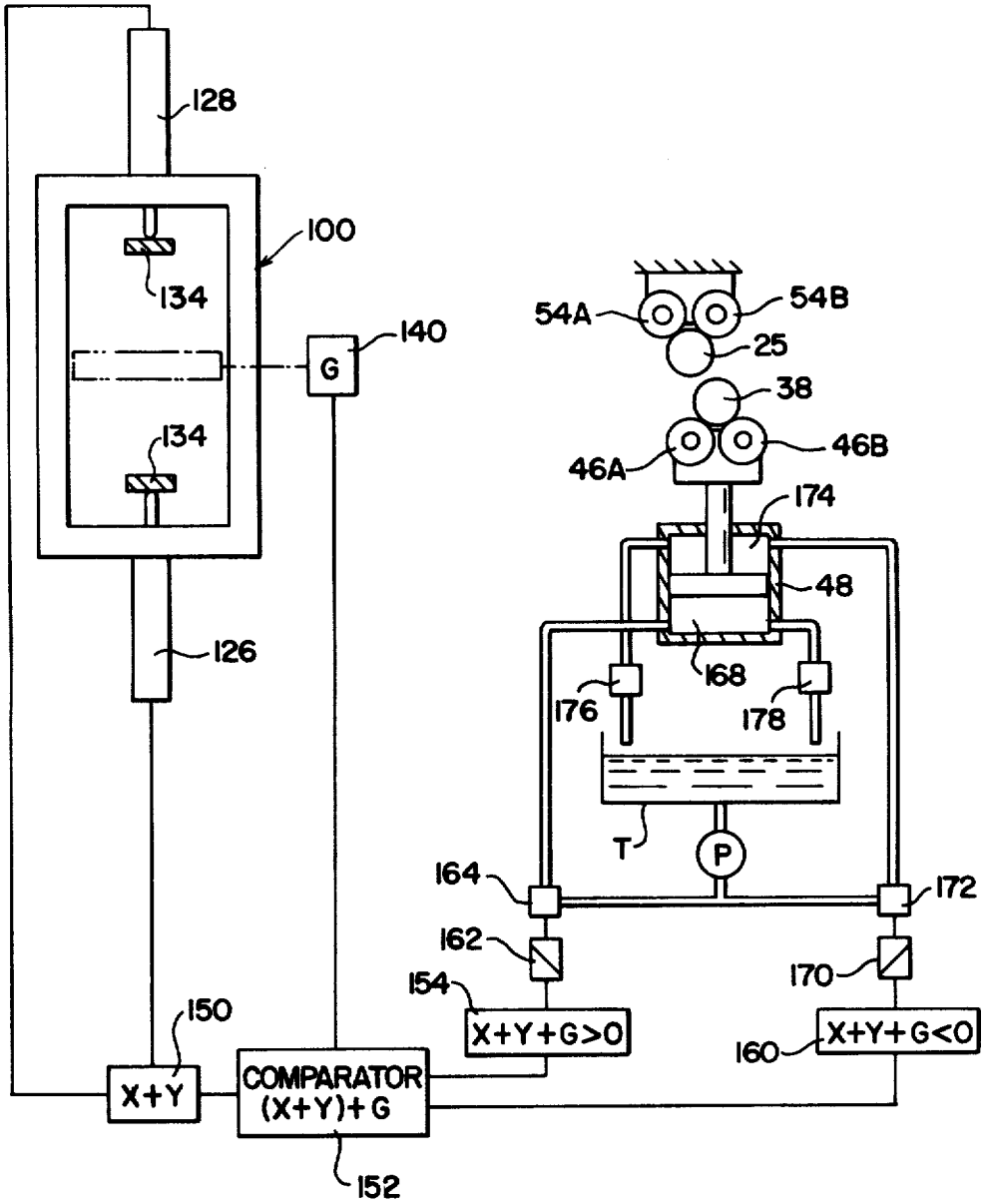
FIG. 19 is a schematic representation of a second preferred embodiment of roller leveler control means.

FIG. 19 schematically illustrates representative control means for the second embodiment of the invention which maintains the desired gap G between work rollers by controlled adjustment of the lower work roller 38 to accommodate the uncontrolled deflection of the upper work roller 25. A signal X from the upper sensor 128 and signal Y from the lower sensor 126 are relayed to a receiver 150 where they are algebraically added. A first combined signal is then relayed to a comparator 152 where it is algebraically added with the preset gap signal G forwarded from preset gap indicator 140. If the algebraic sum of the signals $X+Y+G$ is positive, this second combined signal is relayed to valve solenoid control 154 which actuates valve solenoid 162. Valve solenoid 162 opens valve 164 to connect hydraulic pressure means P to hydraulic cylinder chamber 168 of hydraulic cylinder 48. If the signal $X+Y+G$ is negative, it is relayed to valve solenoid control 160 which actuates valve solenoid 170. Valve solenoid 170 opens valve 172 to connect hydraulic pressure means P to hydraulic cylinder chamber 174 of hydraulic cylinder 48.

As is common practice in the art, when chamber 168 is fluid pressurized, fluid from chamber 174 is permitted by suitable valve means 176 to bleed into tank T. When chamber 174 is fluid pressurized, fluid from chamber 168 bleeds through valve 178 into tank T. Although only the operation of hydraulic cylinder 48 has been described relative to operation of the second embodiment of the invention, it is understood that hydraulic cylinders 48 and 56 are both similarly operated when used in the first embodiment of the invention schematically diagrammed in FIG. 16.

The side members 12 of the roller leveler frame 10 will stretch under the stress of the bending of the work rollers 25 and 38. However, because the sensor support structure 100 is mounted on the frame side members 12, upper and lower sensors 128 will always be referenced to the same predetermined gap, which relationship will always remain constant irrespective of the stretching of the side members of the roller leveler frame. Since the sensor support structure is only mounted at its upper corners no stress or strain will be transmitted to the structure from the roller leveler frame. Therefore, the distance between the upper and lower sensors 128 will always remain constant. Furthermore, the position of fastening of the sensor support structure to the roller leveler frame is at the position of least stretch, as compared to deflection of the work rolls and crown. Accordingly, movement of the sensors 128 due to straining of the roller leveler frame will be minimal. In any event, it is of no consequence in this invention because the predetermined gap between the rollers will also remain constant irrespective of whether both rollers may shift a slight amount upwardly or downwardly due to the stretch of the frame. Because of the slight amount of movement that is actually occuring, such adjustment between rollers to offset frame side stretch is easily made.

In both the first and second embodiments just described, only the outboard ends of the back-up roll support beams are adjustable. In a third embodiment of the invention shown in FIGS. 20, 21 and 22, the back-up roll support beam 44 is articulated by joining portion 44A to portion 44B by means of a clevis 44C and tongue 44T secured by a pin 44P. By adding inboard cylinder 49, in addition to outboard adjustments of the beam, the beam may also be adjusted at its mid-section. Two or more intermediate hydraulic cylinders 49 may be also added to actuate additional back-up roll beam articulation as required.

Figure 23:
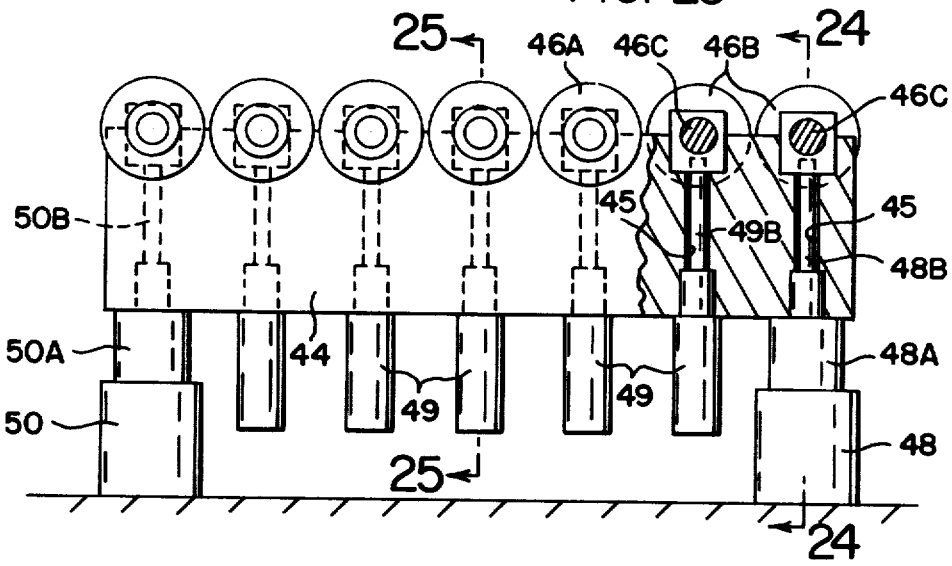
FIG. 23 is a schematic elevational view, partially in section, showing a preferred embodiment of the invention wherein back-up rolls are individually adjustable.
Figure 24:
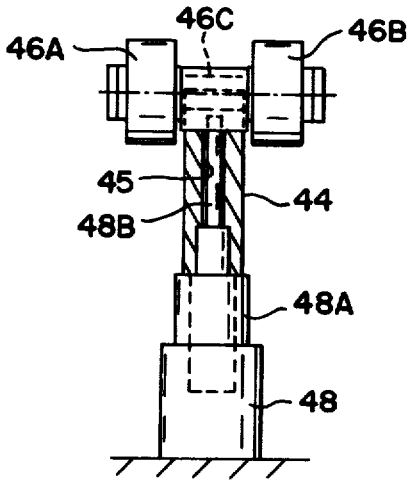
FIG. 24 is a schematic sectional view taken along the line 24—24 of FIG. 23; and, FIG. 25 is a schematic sectional view taken along the line 25—25 of FIG. 23.
Figure 25:
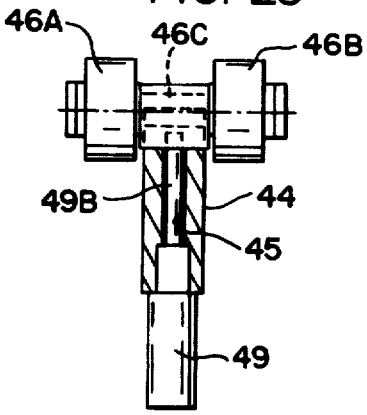

A fourth embodiment of the invention is illustrated in FIGS. 23, 24 and 25. In this embodiment, in addition to outboard hydraulic cylinders 48 and 50, inboard cylinders 49 are provided wherein each set of back-up rolls 46A and 46B may be individually adjusted. The hydraulic cylinder pistons are telescopic in structure and in action, and outboard hydraulic cylinders 48 and 50 are provided with intermediate pistons 48A and 50A, respectively, to provide the outboard back-up roll beam adjustment already described relative to embodiments one, two and three. Additionally, outboard hydraulic cylinders 48 and 50 are modified to include telescopic pistons 48B and 50B which pass through back-up beam bore holes 45 to act directly against outboard back-up roll shafts 46C. Inboard hydraulic cylinders 49 are likewise provided with telescopic pistons 49B which pass through back-up roll beam bore holes 45 to act directly against inboard back-up roll shafts 46C. This fourth embodiment of the invention enables the back-up roll beam 44, in addition to vertical and/or arcuate adjustment of the beam per se, to also adjust the back-up rolls 46A and 46B individually, in combination or as a unit. It will be understood, however, that the use of hydraulic cylinders as shown is for illustrative purposes only. It is also contemplated that other hydraulic back-up roll adjustment means may be used such as a back-up roll beam internal hydraulic system adapted to apply pressure to the back-up rolls. Furthermore, back-up roll beam 44 may be dispensed with if roll adjustment as described relative to embodiments one, two and three is not required. Without back-up roll beam 44, the rolls will be adjusted by separate hydraulic cylinders. Non-load bearing roll cradle means may be desirable in certain applications.

Accordingly, when a strip is being processed having edge waves, the centers of the upper and lower work rollers may be flexed inwardly to stretch the center of the strip as it is being processed through the lower leveler. Once this required gap has been determined and set, the sensor systems described will automatically maintain that gap without operator intervention, as long as the condition of the strip requires correction.

In like manner, when strip is being processed in which its center has been rolled thinner than its edges, the extremities of the upper and lower work rollers may be urged inwardly to stretch the edges of the strip and this inward adjustment will remain constant once it has been preset.

As is apparent from the foregoing description, automatic operation of a roller leveler is provided by novel means which will produce a better quality product at lower cost. It will be understood that the above described embodiments of the invention are for the purpose of illustration only. Additional embodiments, modifications and improvements can be readily anticipated by those skilled in the art based on a reading and study of the present disclosure. Such additional embodiments, modifications and improvements may be fairly presumed to be within the spirit, scope and purview of the invention as defined by the subtended claims.

Having thus described the invention, it is claimed:

1. In a roller leveler including a frame and a plurality of rollers journaled in said frame having preset gaps between pairs of opposed rollers, said opposed rollers and said frame being subject to distortion due to the forces of separation developed by a work product passing between said pairs of rollers, and means to correct the distortion of at least one of said rollers, the improvement comprising: roller distortion sensing and measuring means; and means to actuate said roller distortion correction means responsive to the sensed and measured distortion of at least one of said rollers.

2. The device of claim 1, wherein said frame is an integral non-adjustable structure.

3. The device of claim 1, wherein said sensing and measuring means are continuous and fully automatic.

4. The device of claim 1, including means to record a predetermined desired position of a roller surface; means to compare the deflection of said roller surface with the recorded desired position and means to actuate said roller distortion correction means responsive to this comparison.

5. The device of claim 1, wherein said roller distortion sensing and measuring means is adapted to sense and to measure the distortion of opposed rollers between which said work product is passed, and means responsive to said sensing and measuring means to return said opposed rollers to said preset gap.

6. The device of claim 1, wherein said roller distortion sensing and measuring means is adapted to sense and to measure the distortion of said opposed rollers from said preset gap between which said work product is passed and means responsive to said sensing and measuring means to re-establish said preset gap between said opposed rollers.

7. The device of claim 1, wherein said roller distortion sensing and measuring means is adapted to sense and to measure the distortion of opposed rollers from said preset gap between which said work product is passed, and means responsive to said sensing and measuring means to shape one of said rollers to conform to the distortion of the other of said rollers whereby said predetermined gap between said rollers is restored.

8. The device of claim 1, including means to adjust each back-up roll beam: means to vertically shift each end portion: and means to vertically shift a portion of said beam interior of said end portions.

9. The device of claim 8, wherein said means to shift said beam portions includes means to arcuately shift said portions.

10. The device of claim 8, wherein said beam is articulated.

11. The device of claim 8, wherein said beam comprises at least two portions pivotally connected, and means to shift said beam at said pivotal connection.

12. The device of claim 11, wherein the longitudinal axis of a back-up roll is aligned with said pivotal connection.

13. The device of claim 1, including upper work rollers, upper back-up rolls; upper back-up roll support beams; lower work rollers, lower back-up rolls; and lower back-up rolls support beams, the improvement comprising: means to selectively shift a support beam vertically and/or arcuately; and means to independently and selectively shift at least one of said back-up rolls.

14. The roller leveler of claim 13, wherein said means to shift at least one of said back-up rolls are adapted to selectively shift the outboard rolls independent of the inboard rolls.

15. The roller leveler of claim 13, wherein said means to shift at least one of said back-up rolls are adapted to selectively shift the inboard rolls independent of the outboard rolls.

16. The roller leveler of claim 13, including selectively controllable pressure means, and wherein said support beam is counterbored to communicate said pressure means to said back-up roll means.

17. The roller leveler of claim 16, wherein said pressure means comprise hydraulic jacks, the pistons of which are received within said counterbores to engage the undersides of said back-up roll means for selective shifting thereof.

18. In a roller leveler including a frame and a plurality of rollers journaled in said frame having preset gaps between pairs of opposed rollers, said rollers and said frame being subject to distortion due to the forces of separation developed by a work product passing between said pairs of opposed rollers, and means to correct the distortion of at least one of said rollers, the improvement comprising: roller distortion sensing and measuring means isolated from the distortion of said frame and said rollers, and means to actuate said roller distortion correction means responsive to the sensed and measured distortion of at least one of said rollers.

19. The device of claim 18, wherein said frame is an integral, rigid, non-adjustable structure.

20. The device of claim 18, wherein said sensing and measuring means are continuous and fully automatic.

21. The device of claim 18, including means to record a predetermined position of a roller surface; means to compare the deflection of said roller surface with the recorded predetermined position and to actuate said roller distortion correction means responsive to said comparison.

22. The device of claim 18, wherein said roller distortion sensing and measuring means is adapted to sense and to measure the distortion of opposed rollers between which said work product is passed, and means responsive to said sensing and measuring means to return said rollers to said preset gap.

23. The device of claim 18, wherein said roller distortion sensing and measuring means is adapted to sense and to measure the distortion of opposed rollers from said preset gap between which said work product is passed and means responsive to said sensing and measuring means to re-establish said preset gap between said rollers.

24. The device of claim 18, wherein said roller distortion sensing and measuring means is adapted to sense and to measure the distortion of opposed rollers from said preset gap between which said work product is passed, and means responsive to said sensing and measuring means to shape one of said rollers to conform to the distortion of the other of said rollers whereby said predetermined gap between said rollers is restored.

25. In a roller leveler including a frame; a first bank of rollers journaled in said frame having an entrance roller, an exit roller, and intermediate rollers therebetween; a second bank of rollers journaled in said frame having an entrance roller, an exit roller, and intermediate rollers therebetween, said first bank of rollers being parallel to and above said second bank of rollers; means to position one of said bank of rollers relative to the other bank of rollers to provide a predeterminable gap therebetween; said rollers being subject to distortion due to the forces of separation on said rollers caused by a work product being processed through said predetermined gap; and means to correct the distortion of said rollers to maintain said predetermined gap, the improvement comprising: means positioned across the width of said frame to measure the varying amounts of distortion of said entrance rollers at various positions along the longitudinal axes of said entrance rollers; means positioned across the width of said frame to measure the varying amounts of distortion of said exit rollers at various positions along the longitudinal axes of said exit rollers; means responsive to said measurements to actuate said distortion correction means to correct said roller distortions by returning said rollers to their respective predetermined gap positions.

26. The device of claim 25, wherein said roller distortion measuring means are isolated from distortion of said frame.

27. The device of claim 25, wherein said roller distortion measuring means are suspended from said frame at places of minimum frame distortion.

28. The device of claim 25, wherein said frame is an integral, non-adjustable structure.

29. The device of claim 25, including bracket means at the entrance of said roller leveler and bracket means at the exit of said roller leveler upon which to mount said roller distortion measuring means.

30. The device of claim 29, wherein said roller distortion means are mounted on said entrance bracket means to monitor the upper of said entrance rollers; roller distortion measuring means are mounted on said entrance bracket means to monitor the lower of said entrance rollers; said entrance bracket means being adapted to maintain said upper and lower entrance roller distortion measuring means at a fixed distance apart irrespective of roller and frame distortion; roller distortion measuring means are mounted on said exit bracket means to monitor the upper of said exit rollers; roller distortion measuring means are mounted on said exit bracket means to monitor the lower of said exit rollers; and said exit bracket means being adapted to maintain said upper and lower exit roller distortion measuring means at a fixed distance apart irrespective of exit roller and frame distortion.

31. The device of claim 29, wherein said bracket means are isolated from said frame and roller distortion.

32. The device of claim 29, wherein said entrance and exit bracket means are free standing and isolated from frame and roller distortion.

33. The device of claim 29, wherein said entrance and exit bracket means are each suspended from portions of said roller leveler frame least subject to strain due to said forces of roller separation.

34. The device of claim 29, wherein said entrance and exit bracket means each comprise an upper cross member; a lower cross member; means to suspend said lower cross member from said upper cross member; and means to secure said upper cross member to portions of said leveler roller frame least subject to strain due to said forces of roller separation.

35. The device of claim 34, including means to maintain said lower cross member a constant distance from said upper cross member.

36. The device of claim 34, including means to vertically shift said lower cross member a distance equal to any vertical shifting of said upper cross member due to said strain of said roller leveler frame portions.

37. In a roller leveler including a frame, a first bank of rollers journaled in said frame having outboard rollers and intermediate rollers therebetween; a first bank of back-up rolls mounted on a plurality of back-up roll beams extending from front to rear and spaced apart from side to side of said frame; a second bank of rollers journaled in said frame having outboard and intermediate rollers therebetween; a second bank of back-up rolls mounted on a plurality of back-up roll beams extending from front to rear and spaced apart from side to side of said frame; said first bank of rollers being parallel to and above said second bank of rollers; means to position one of said bank of rollers relative to the other of said bank of rollers to provide a predeterminable gap therebetween; said rollers being subject to bending deflection due to the forces of separation on said rollers caused by a work product being processed through said predeterminable gap; and means to compensate for said bending deflection, the improvement comprising: automatic means to selectively shift each of said back-up roll beams indpendent of any other back-up roll beams adjacent one of said banks of rollers to exert selective pressure against said one of said banks of rollers during levelling of a work product passing through the roller gap; first means to automatically detect bending deflection of said one of said outboard rollers of said one of said banks of rollers; and first means responsive to said first detection means to automatically actuate said means to shift a selected back-up roll beam until said roller bending deflection of said one of said banks of rollers has been corrected during levelling of a work product passing through the roller gap.

38. The device of claim 37, including second means to detect bending deflection of one of said outboard rollers of said other of said banks of rollers; bracket means to mount said first and second detection means a constant distance apart adjacent said first and second banks of rollers respectively, and said bracket means being non-deformable and substantially isolated from roller leveler frame stretching and roll bending forces.

39. The device of claim 37, including second means to detect bending deflection of one of said outboard rollers of said other of said banks of rollers; and means to bend said one of said banks of rollers in the same direction of the bending of said other of said banks of rollers to maintain a constant gap therebetween.

40. The device of claim 37, including means to shift the rollers of the other of said banks of rollers; means to selectively shift the back-up roll beams adjacent the other of said banks of rollers to exert selective pressure against said other of said banks of rollers; second means to detect bending deflection of said outboard rollers of said other of said banks of rollers; and second means responsive to said second detection means to actuate said means to shift said selected back-up roll beam until said roller bending deflection of said other of said banks of rollers has been corrected.

41. The device of claim 40, including means to isolate said first and second detecting means from the stresses and strains in said frame induced by the forces of roller bending.

42. The device of claim 41, including bracket means securable to opposite side members of said frame adapted for mounting thereon said first detecting means a fixed distance from said second detecting means, said bracket means dimensionally unchangeable by said stresses and strains in said frame.

43. In a roller leveler mechanism including a frame; a plurality of rollers subject to bending and forces of deflection mounted in said frame; a plurality of back-up rolls mounted in said frame to support said rollers, and roller bending adjustment means, the improvement in said roller bending adjustment means comprising:

(a) a sensor mounting structure positioned on the frame so as to be isolated from the forces of deflection acting on said rollers;

(b) roller bending sensing means mounted on said sensor mounting structure, and (c) means mounted on said frame to actuate said roller bending adjustment means responsive to the amount of bending sensed by said sensing means.

44. The device of claim 43, wherein said sensor mounting structure comprises a structural member secured to the portion of said roller leveler frame least subject to the forces of deformation during operation of said roller leveler.

45. The device of claim 43, wherein said means to sense roller bending includes a cantilevered rod mounted on back-up roll supporting means to shift with bending of a roller; sensor means having a shiftable probe, and said cantilevered rod of said beam being adapted to contact said shiftable probe to shift said probe proportionate to the shifting of said cantilevered rod.

46. The device of claim 43, wherein said means to detect said roller bending comprises means to generate a signal; and means to detect a variation in said signal caused by bending of said rollers.

47. The device of claim 43, wherein said means to detect said roller bending comprises means to generate an optical signal; and means to detect variation in said signal caused by bending of said rollers.

48. The device of claim 43, wherein said means to detect said roller bending comprises means to generate a sonar signal; and means to detect a variation in said signal caused by bending of said rollers.

49. The device of claim 43, wherein said means to detect said roller bending comprises means to generate a laser beam signal; and means to detect a variation in said laser beam signal caused by bending of said rollers.

50. The device of claim 43, wherein said means to detect said roller bending comprises a fiber optic signal; and means to detect a variation in said signal caused by bending of said rollers.

51. In a roller leveler having upper work rollers; flights of upper back-up rolls; lower work rollers; and flights of lower back-up rolls, the improvements comprising: an integral frame to journal said rollers and rolls including a base, spaced apart upstanding side members rigidly secured to said base and a top member rigidly secured to the tops of said side members; a sensor mounting frame having an upper member secured at its opposite ends to said frame side members; a lower member spaced a fixed distance beneath said upper member and suspended therefrom; sensors mounted on said sensor mounting frame upper member adjacent the outboard back-up rolls of said flights of upper back-up rolls; sensors mounted on said sensor mounting frame lower member adjacent the outboard back-up rolls of said flights of lower back-up rolls; said upper and lower sensors being adapted to sense and to signal the shifting of adjacent back-up rollers; and means to vertically adjust said back-up rollers responsive to said sensing signal.

52. The roller leveler of claim 51, including back-up roll beams upon which said back-up rolls are rotatably mounted; means to shift said beams and means to process said sensing signals to actuate said means to shift said beams.

53. In a roller leveler including a frame, upper and lower deflectable rollers journaled in said frame having a predetermined gap therebetween when said rollers are not deflected and wherein said upper and lower rollers perform levelling on a work product passing through said gap and flights of upper and lower back-up rolls to support said rollers, the improvement comprising: roller deflection detection means, a cradle to support each flight of back-up rolls; and automatic means to selectively shift and tilt said cradle responsive to detection of roller deflection by said roller deflection detection means so as to correct the roller deflection as said work product is levelled.

54. In a roller leveler including a frame, upper and lower deflectable rollers journaled in said frame having a predetermined gap therebetween when said rollers are not deflected and wherein said upper and lower rollers perform levelling on a work product passing through said gap and flights of upper and lower sets of back-up rolls to support said rollers, the improvement comprising: roller deflection detection means; a cradle to support each flight of said sets of back-up rolls; and automatic means to selectively shift a single set of said back-up rolls responsive to detection of roller deflection by said roller deflection detection means so as to correct the roller deflection as said work product is levelled.

55. In a roller leveler including a frame, upper and lower deflectable rollers journaled in said frame having a predetermined gap therebetween when said rollers are not deflected and wherein said upper and lower rollers perform levelling on a work product passing through said gap and flights of upper and lower sets of back-up rolls to support said rollers, the improvement comprising: roller deflection detection means; a cradle to support each flight of said sets of back-up rolls; automatic means to selectively shift and tilt said cradle responsive to detection of roller deflection by said roller deflection detection means; and automatic means to selectively shift a single set of said back-up rolls responsive to detection of roller deflection by said roller deflection detection means so as to correct the roller deflection as said work product is levelled.

* * * * *